US009435091B2

(12) United States Patent
Kawakami et al.

(10) Patent No.: US 9,435,091 B2
(45) Date of Patent: Sep. 6, 2016

(54) SNOW REMOVAL MACHINE

(71) Applicant: HONDA MOTOR CO., LTD., Tokyo (JP)

(72) Inventors: Toshiaki Kawakami, Wako (JP); Tsutomu Mizoroke, Wako (JP); Jun Fukano, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/150,826

(22) Filed: Jan. 9, 2014

(65) Prior Publication Data

US 2014/0202047 A1 Jul. 24, 2014

(30) Foreign Application Priority Data

Jan. 22, 2013 (JP) ..... 2013-009281

(51) Int. Cl.
*E01H 5/09* (2006.01)
*E01H 5/04* (2006.01)

(52) U.S. Cl.
CPC ..... *E01H 5/098* (2013.01); *E01H 5/04* (2013.01)

(58) Field of Classification Search
CPC ..... E01H 5/04; E01H 5/098
USPC ..... 37/234, 242, 244, 245, 254, 257; 172/821, 822, 823, 4.5
See application file for complete search history.

(56) References Cited

U.S. PATENT DOCUMENTS

| | | | | |
|---|---|---|---|---|
| 5,487,428 | A * | 1/1996 | Yamamoto et al. | 172/4.5 |
| 5,938,399 | A * | 8/1999 | Knutson | 414/722 |
| 7,351,028 | B2 * | 4/2008 | Potter et al. | 414/723 |
| 7,581,339 | B2 * | 9/2009 | Mizoroke et al. | 37/234 |
| 7,673,402 | B2 * | 3/2010 | Wakitani et al. | 37/348 |
| 7,681,339 | B2 * | 3/2010 | Wakitani et al. | 37/348 |
| 7,997,016 | B2 * | 8/2011 | Yamazaki et al. | 37/234 |
| 8,065,823 | B2 * | 11/2011 | Morrell | 37/254 |
| 2005/0039352 | A1 * | 2/2005 | Sakai et al. | 37/242 |
| 2005/0039353 | A1 * | 2/2005 | Hanafusa et al. | 37/242 |
| 2007/0022634 | A1 * | 2/2007 | Yamazaki et al. | 37/244 |

FOREIGN PATENT DOCUMENTS

| | | |
|---|---|---|
| JP | 63-136012 U | 9/1988 |
| JP | 2007-32218 A | 2/2007 |

* cited by examiner

*Primary Examiner* — Jamie L McGowan
(74) *Attorney, Agent, or Firm* — Westerman, Hattori, Daniels & Adrian, LLP

(57) ABSTRACT

A snow removal machine including a travel unit frame having travel units, and an auger housing liftable, lowerable and rollable relative to the travel unit frame. The machine also includes: a frame inclination angle detection section for detecting an inclination angle of the travel frame relative to a ground surface; a housing inclination angle detection section for detecting an inclination angle of the auger housing relative to the travel unit frame; and an overall inclination angle evaluation section for evaluating an overall inclination angle of the auger housing relative to the ground surface on the basis of the inclination angles detected by the two detection sections. The two detection sections are provided on a part of the machine which does not make rolling motion together with the auger housing.

11 Claims, 14 Drawing Sheets

SNOW REMOVAL MACHINE

TECHNICAL FIELD

The present disclosure relates to self-propelled snow removal machines having left and right travel units and an auger.

BACKGROUND

Among the conventionally-known snow removal machines are the auger-type snow removal machines which include an auger housing mounted on a vehicle body frame, having travel units mounted thereon, in such a manner that it is movable up and down and rollable side to side relative to the vehicle body frame. The auger housing houses an auger located at the front of the snow removal machine, so that the snow removal machine can gather snow by means the auger and blow the gathered snow far away through a shooter by means of a blower while traveling forward.

Generally, the auger-equipped snow removal machines are constructed to allow a height of the auger housing to be changed in accordance with conditions of snow removal work. The snow removal machine can travel more efficiently if the underside of the auger housing is positioned higher, but the snow removal machine snow can remove snow more efficiently if the underside of the auger housing is positioned lower. Additionally, during the snow removal work, the height of the auger housing is often changed or adjusted in accordance with irregularities (concavities and convexities) of road surfaces. However, if the height of the auger housing is adjusted by a human operator inputting appropriate heights through a control panel or the like, loads on the human operator tend to increase. In order to reduce such human operator's loads, there have been proposed snow removal machines constructed to lift and lower the housing and hence the lower surface of the auger housing through automatic force, as disclosed in Japanese Utility Model Application Laid-Open Publication No. SHO-63-136012 (hereinafter referred to as "Patent Literature 1") and Japanese Patent Application Laid-Open Publication No. 2007-32218 (hereinafter referred to as "Patent Literature 2").

In the snow removal machine disclosed in Patent Literature 1, an inclination of the auger housing is detected by an inclination detection device provided on the auger housing so as to control a rolling angle of the auger housing. In the snow removal machine disclosed in Patent Literature 2, a height position, in a lifting/lowering direction, of the auger housing is detected by a height position sensor and an inclined position of the auger housing is detected by a roll position sensor so as to control a lifting/lowering angle and a rolling angle of the auger housing.

However, during the snow removal work, vibrations and impacts occurring in the auger and the blower may undesirably transmit from the auger housing to the detection sections. Thus, further improvements have to be made to accurately detect an inclination angle of the auger housing and increase durability of the detection sections.

SUMMARY

In view of the foregoing prior art problems, it is preferable to provide an improved technique which can accurately detect an inclination angle of the auger housing relative to a ground surface which a travel unit is contacting, and which can increase durability of a detection section for detecting an inclination angle.

Here, the present disclosure provides an improved snow removal machine including a travel unit frame having a travel unit mounted thereon, and an auger housing having an auger housed therein and not only liftable/lowerable but also rollable relative to the travel unit frame, which comprises: a frame inclination angle detection section for detecting an inclination angle of the travel frame itself relative to a ground surface the travel unit is contacting; a housing inclination angle detection section for detecting an inclination angle of the auger housing relative to the travel unit frame; and an overall inclination angle evaluation section for evaluating an overall inclination angle of the auger housing relative to the ground surface on the basis of the inclination angle detected by the frame inclination angle detection section and the inclination angle detected by the housing inclination angle detection section, the frame inclination angle detection section and the housing inclination angle detection section being provided on a part of the snow removal machine which does not make rolling motion together with the auger housing.

In the snow removal machine of the present disclosure, the frame inclination angle detection section for detecting an inclination angle of the travel frame itself relative to the ground surface the travel unit is contacting and the housing inclination angle detection section for detecting an inclination angle of the auger housing relative to the travel unit frame are provided on a part of the snow removal machine, such as a vehicle body frame, which does not make rolling motion together with the auger housing. With such an arrangement, the present disclosure can effectively prevent vibrations and impacts, occurring in the auger and a blower, from transmitting from the auger housing (and a blower case) directly to the frame inclination angle detection section and the housing inclination angle detection section and thereby increase durability of the detection sections. Besides, the frame inclination angle detection section and the housing inclination angle detection section are insusceptible to vibrations, these detection sections can have highly sensitive responsiveness.

Further, the snow removal machine of the present disclosure, where the frame inclination angle detection section detects an inclination angle of the travel frame itself relative to the ground surface the travel unit is contacting, can accurately detect an inclination angle of the travel frame. Then, the overall inclination angle evaluation section evaluates an overall inclination angle of the auger housing relative to the ground surface on the basis of the inclination angle detected by the frame inclination angle detection section and the inclination angle detected by the housing inclination angle detection section. Thus, an extremely accurate overall inclination can be obtained with an inexpensive construction, as a result of which inclination control of the auger housing can be performed with increased accuracy and efficiency.

Preferably, the snow removal machine of the present disclosure further comprises: a lifting/lowering drive mechanism for lifting and lowering the auger housing; a rolling drive mechanism for rolling the auger housing; a housing posture operation section for operating the lifting/lowering drive mechanism and the rolling drive mechanism; an inclination storage section for storing the overall inclination angle detected at an operation end time point when an operation via the housing posture control section has been ended; and a housing posture control section for, following the operation end time point, controlling the lifting/lowering drive mechanism and the rolling drive mechanism in such a manner that the overall inclination angle stored in the inclination storage section is maintained.

Namely, according to the preferred implementation, the overall inclination angle detected at the operation end time point when human operator's operations performed via the housing posture control section for manipulating or operating the drive mechanisms that lift/lower or roll the auger housing has been ended is stored in the inclination storage section. Following the operation end time point, the housing posture control section controls the lifting/lowering drive mechanism and the rolling drive mechanism in such a manner that the overall inclination angle stored in the inclination storage section is maintained. Thus, irrespective of variations of the ground surface the travel unit is contacting, i.e., irrespective of variations of the posture of the travel unit frame, the snow removal machine of the disclosure can smoothly continue snow removal work by constantly maintaining such an overall inclination angle corresponding to working conditions the snow removal machine was in immediately before the operation end time point. In this way, it is possible to significantly enhance operability of snow removal work by the snow removal machine. For example, because the housing posture control section performs control for constantly maintaining such an overall inclination angle manipulated as desired by the human operator in accordance with conditions of the snow removal work, automatic control of the auger housing can be appropriately assisted in various conditions of the snow removal work.

Generally, some snow is left on the road surface having been subjected to the snow removal work by the snow removal machine. Skill is required to perform the snow removal work in such a manner that snow remains on the road surface almost flatly at a given angle. However, according to the present disclosure, the overall inclination angle is constantly maintained as above, so that, even if the human operator is not a skilled operator, he or she can readily perform the snow removal work in such a manner that snow is left on the road surface almost flatly at a given angle.

Further, even when the posture of the travel unit frame has inclined due to external disturbance, for example, the auger housing in the snow removal machine of the disclosure can maintain a posture which it was in till immediately before the external disturbance. Further, in a case where quality of snow (such as density of accumulated snow) differs between the left side and the right side of the auger housing, the snow can be removed with the travel unit frame kept in a horizontal posture if a left-right posture of the auger housing is subjected to a rolling operation in advance such that a side of the auger housing located over softer snow (softer-snow side of the auger housing) is positioned higher than the other side.

Further, for snow accumulated higher than the auger housing, i.e. for a slightly high snow mountain, the snow removal machine generally remove the snow sequentially from top to bottom (in a so-called "horizontal stepped cutting" fashion). However, because the snow quality is not necessarily uniform, great loads would be imposed on the human operator in order to maintain a suitable posture of the travel frame unit. To avoid such an inconvenience, the present disclosure is constructed to allow the human operator to preset, via the housing posture operation section, an inclination angle of the auger housing for an upward sloping surface (uprise) of the snow mountain, so that the inclination angle of the auger housing can be automatically controlled following the operation end time point. Thus, not only horizontal stepped cutting but also oblique stepped cutting where the machine removes snow while traveling forward or rearward along an upward sloping surface of a snow mountain can be facilitated by the present disclosure. Further, even where the travel unit frame has sunk in accumulated snow, the auger housing can be automatically controlled to be maintained at a given inclination angle. In this way, the number of necessary posture adjusting operations of the auger housing can be reduced, so that loads on the human operator can be significantly alleviated.

Preferably, in the snow removal machine of the present disclosure, the housing posture control section performs control for maintaining the overall inclination angle upon determination that both of a first condition that the auger is rotating and a second condition that the snow removal machine is traveling forward is satisfied. According to this preferred implementation, only when the auger housing has been rotated while the snow removal machine is traveling forward, the housing posture control section performs control for maintaining the overall inclination angle. However, when the snow removal machine is not performing snow removal work, such as when the snow removal machine is traveling rearward, such overall-inclination-angle maintaining control is not performed because there is no need to maintain the overall inclination angle. Thus, the human operator can freely perform lifting/lowering and rolling operations of the auger housing. Because the human operator can easily operate the auger housing in accordance with a current situation, it is possible for the human operator to efficiently operate the auger housing with no waste.

Preferably, in the snow removal machine of the present disclosure, the overall inclination angle evaluation section has a filter function that, upon determination that the snow removal machine is traveling at an accelerating or decelerating speed or making a turn, slowly changes a value of the inclination angle detected by the frame inclination angle detection section. According to this preferred implementation, the overall inclination angle evaluation section slowly changes the value of the inclination angle, detected by the frame inclination angle detection section, when the snow removal machine is traveling at an accelerating or decelerating speed or making a turn. Thus, the detected inclination angle is insusceptible to short-lasting external disturbances (acceleration, centrifugal force, etc.) that may occur when the snow removal machine is traveling at an accelerating or decelerating speed or making a turn. As a consequence, the value of the inclination angle can stabilize without extreme variations, and thus, the inclination control of the auger housing can be performed accurately and appropriately.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

In the following description, the terms "front", "rear", "left", "right", "upward", "downward" etc. are used to refer to directions as viewed from a human operator operating a snow removal machine of the embodiments.

Figure 1:
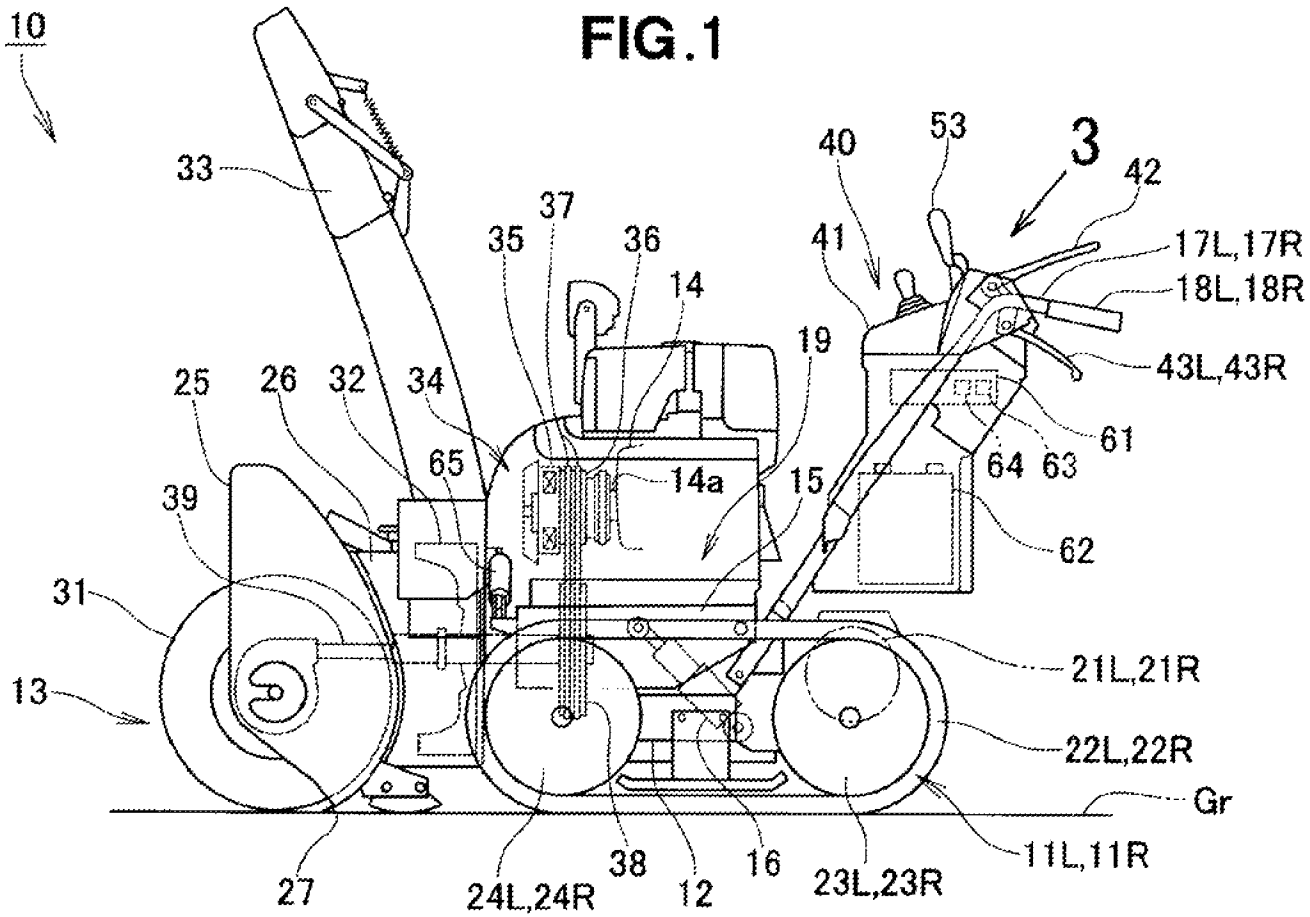
FIG. 1 is a side view of an embodiment of a snow removal machine of the present invention.
Figure 2:
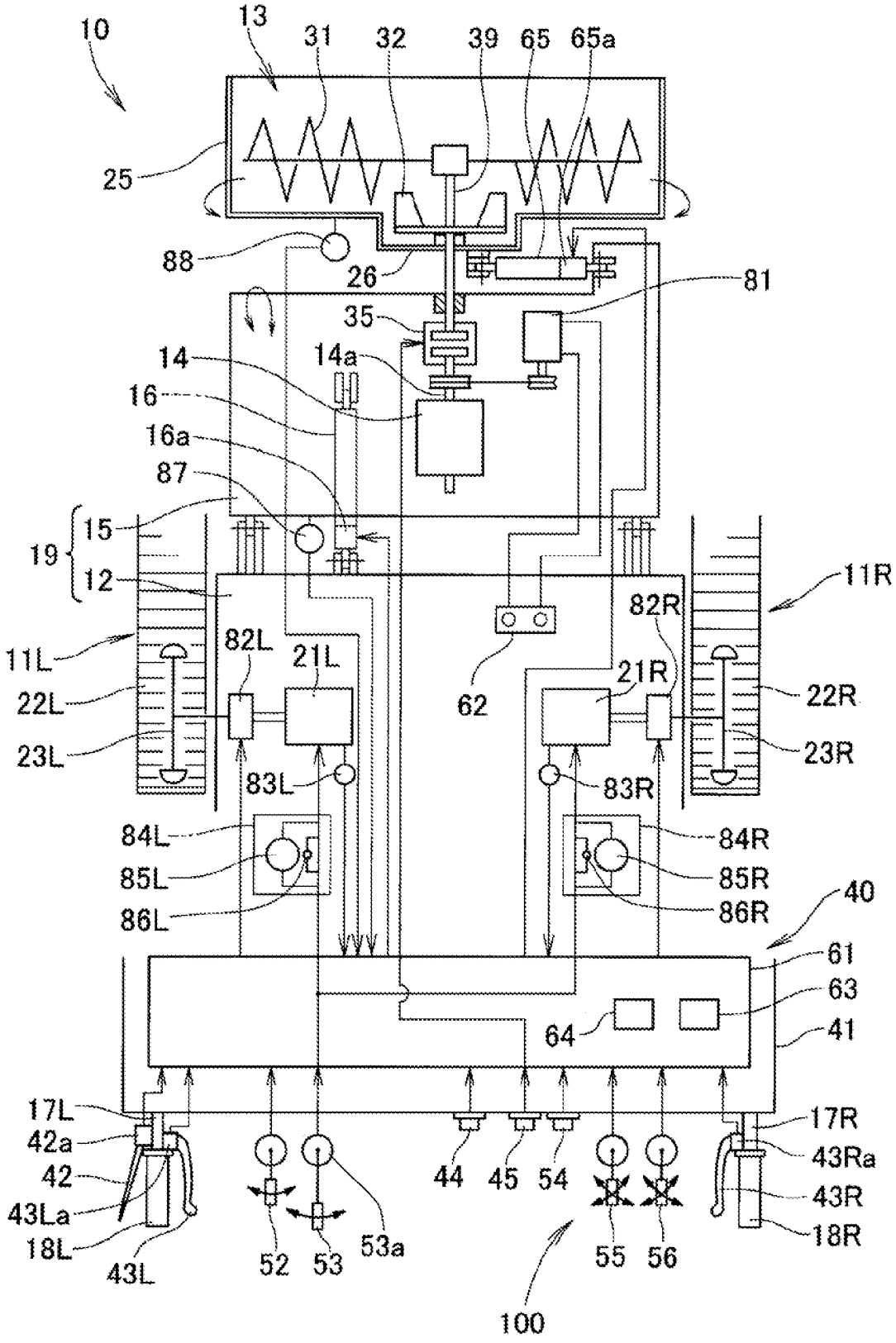
FIG. 2 is a schematic plan view of the snow removal machine shown in FIG. 1, which is particularly explanatory of a control system employed in the snow removal machine.

An embodiment of the snow removal machine 10 of the present invention, as shown in FIGS. 1 and 2, is a self-propelled auger-type snow removal machine 10 which includes: a travel unit frame 12 having left and right travel units 11L and 11R mounted thereon; a vehicle body frame 15 vertically pivotable connected at a rear end portion thereof to the travel unit frame 12 and having mounted thereon a snow removal work section 13 and an engine 14 for driving the snow removal work section 13; a lifting/lowering drive mechanism 16 for pivotally moving a front portion of the vehicle body frame 15 upward and downward; a pair of left and right operating handles 17L and 17R extending rearward and upward from a rear portion of the travel unit frame 12; and left and right grips 18L and 18R mounted on distal end portions of the left and right operating handles 17L and 17R, respectively.

The travel unit frame 12 and the vehicle body frame 15 together constitute a machine body 19. The travel unit frame 12 also has mounted thereon left and right electric motors 21L and 21R for driving the left and right travel units 11L and 11R, respectively. The left and right electric motors 21L and 21R each comprise: a left or right crawler belt 22L or 22R; a left or right driving wheel 23L or 23R provided on a rear portion of the snow removal machine 10 as a left or right traveling wheel and meshing with the inner surface of a rear portion of the left or right crawler belt 22L or 22R; and a left or right driven wheel 24L or 24R provided on a front portion of the snow removal machine 10.

The left crawler belt 22L can be driven by the left electric motor 21L via the left driving wheel 23L, while the right crawler belt 22R can be driven by the right electric motor 21R via the right driving wheel 23R.

The self-propelled auger-type snow removal work section 13 includes: an auger housing 25; a blower case 26 formed integrally with the back surface of the auger housing 25; an auger 31 housed in the auger housing 25; a blower 32 housed in the blower case 26. The auger housing 25 includes a scraper 27 at its lower end.

The engine 14 is a snow removing drive source for driving the snow removal work section 13 via a snow removing power transmission mechanism 34. The snow removing power transmission mechanism 34 includes a driving pulley 36 mounted on a crankshaft 14*a* of the engine 14 via an electromagnetic clutch 35, a transmission belt 37, and a rotation shaft 39 having a driven pulley 38 mounted thereon.

Power of the engine 14 is transmitted to the auger 31 and the blower 32 via the crankshaft 14*a*, electromagnetic clutch 35, driving pulley 36, transmission belt 37, driven pulley 38 and rotation shaft 39 in the order named. Thus, snow gathered by the auger 31 can be blown far away by the blower 32 via the shooter 33.

The lifting/lowering drive mechanism 16 is an actuator having a piston projectable and retractable from and into a cylinder. This actuator is an electric hydraulic cylinder of a type where the piston is caused to project and retract by hydraulic pressure generated from a not-shown hydraulic pump driven by the electric motor 16*a* (see FIG. 2). The electric motor 16*a* is an lifting/lowering drive source integrally incorporated in a side of the lifting/lowering drive mechanism 16.

The lifting/lowering drive mechanism 16 is vertically pivotably connected at its one end to the travel unit frame 12 and vertically pivotably connected at the other one end to the vehicle body frame 15. Thus, the vehicle body frame 15, auger housing 25 and blower case 26 can be lifted and lowered (i.e., pivoted in a vertical or up-down direction) by means of the lifting/lowering drive mechanism 16.

The human operator can operate the snow removal machine 10 with the left and right operating handles 17L and 17R while walking behind the machine 10. In the illustrated embodiment, an operation box 41, a control section 61 and a battery 62 are provided between the left and right operating handles 17L and 17R and arranged vertically one above another in the order named.

Further, in the snow removal machine 10, the auger housing 25 and the blower case 26 are mounted on the vehicle body frame 15 in such a manner that they can roll. The auger housing 25 can be rolled by a rolling drive mechanism 65.

Figure 7:
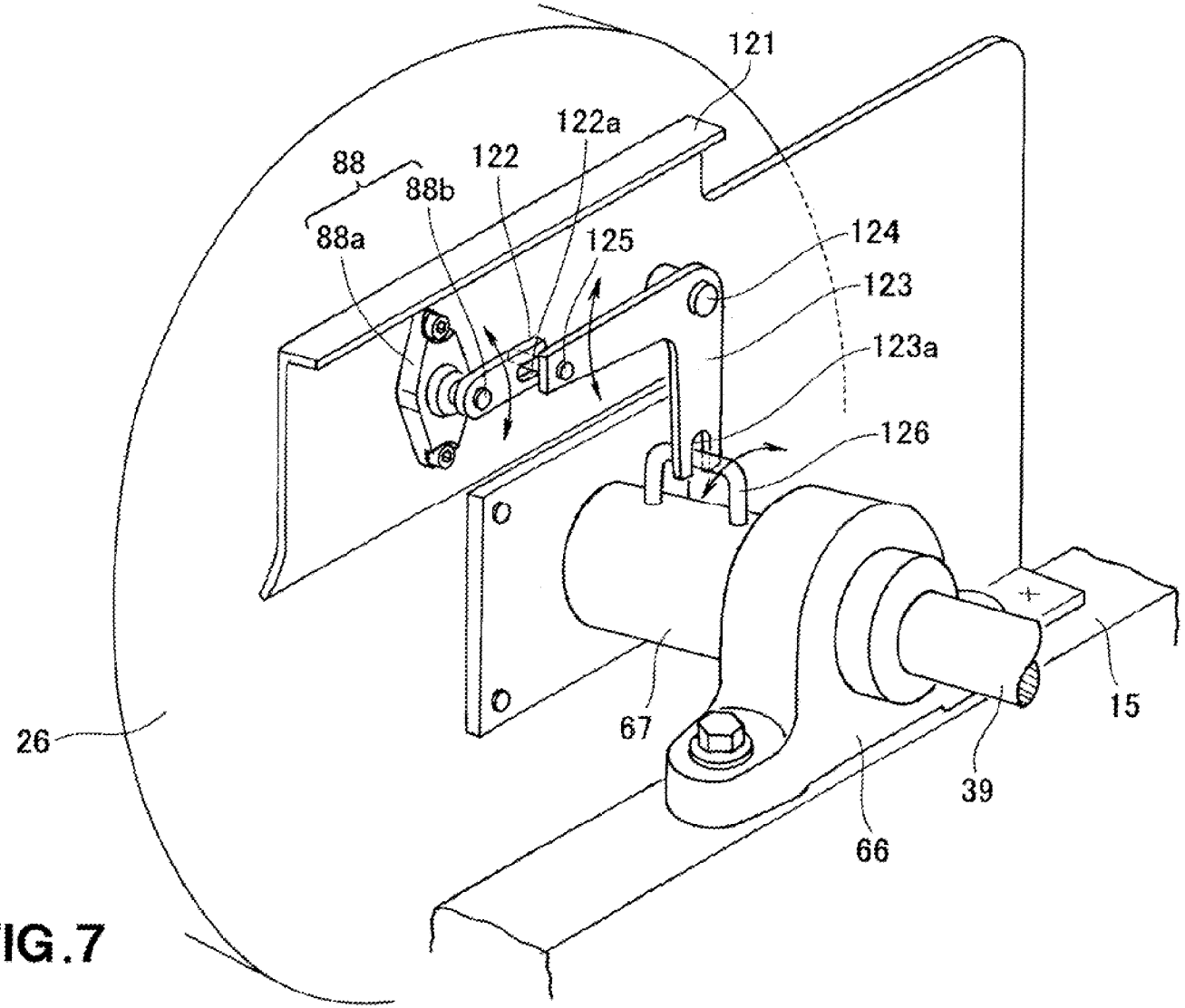
FIG. 7 is a rear perspective view showing how a rolling position sensor shown in FIG. 5 is assembled.

More specifically, as shown in FIG. 7, a rotation support section 67 is supported on a front end portion of the vehicle body frame 15 via a bearing 66 in such a manner that it is rotatable in leftward and rightward (counterclockwise and clockwise) directions. The blower case 26 is connected at its rear end portion to the rotation support section 67, and the rotation shaft 39, extending in a front-rear direction, is supported by the rotation support section 67 in such a manner that it is rotatable in the leftward and rightward (counterclockwise and clockwise) directions. Thus, the auger housing 25 and the blower case 26 are mounted on the vehicle body frame 15 in such a manner that they are rotatable (rollable) relative to the vehicle body frame 15 in the counterclockwise and clockwise directions.

With the vehicle body frame 15 mounted on the travel unit frame 12 as noted above, the auger housing 25 and the blower case 26 are mounted on the travel unit frame 12 for rolling (i.e., side-to-side swaying or rocking) movement. Thus, the auger housing 25 is not only liftable/lowerable but also rollable relative to the travel unit frame 12.

The rolling drive mechanism 65 is an actuator having a piston projectable and retractable from and into a cylinder.

This actuator is an electric hydraulic cylinder of a type where the piston is caused to project or retract by hydraulic pressure generated from a not-shown hydraulic pump driven by an electric motor 65*a*. The electric motor 65*a* is a rolling drive source integrally incorporated in a side of the rolling drive mechanism 65.

The rolling drive mechanism 65 is horizontally pivotably mounted at its one end on the vehicle body frame 15 and mounted at the other end on the back surface of the blower case 26. The auger housing 25 and the blower case 26 can be rolled by the rolling drive mechanism 65.

Figure 3:
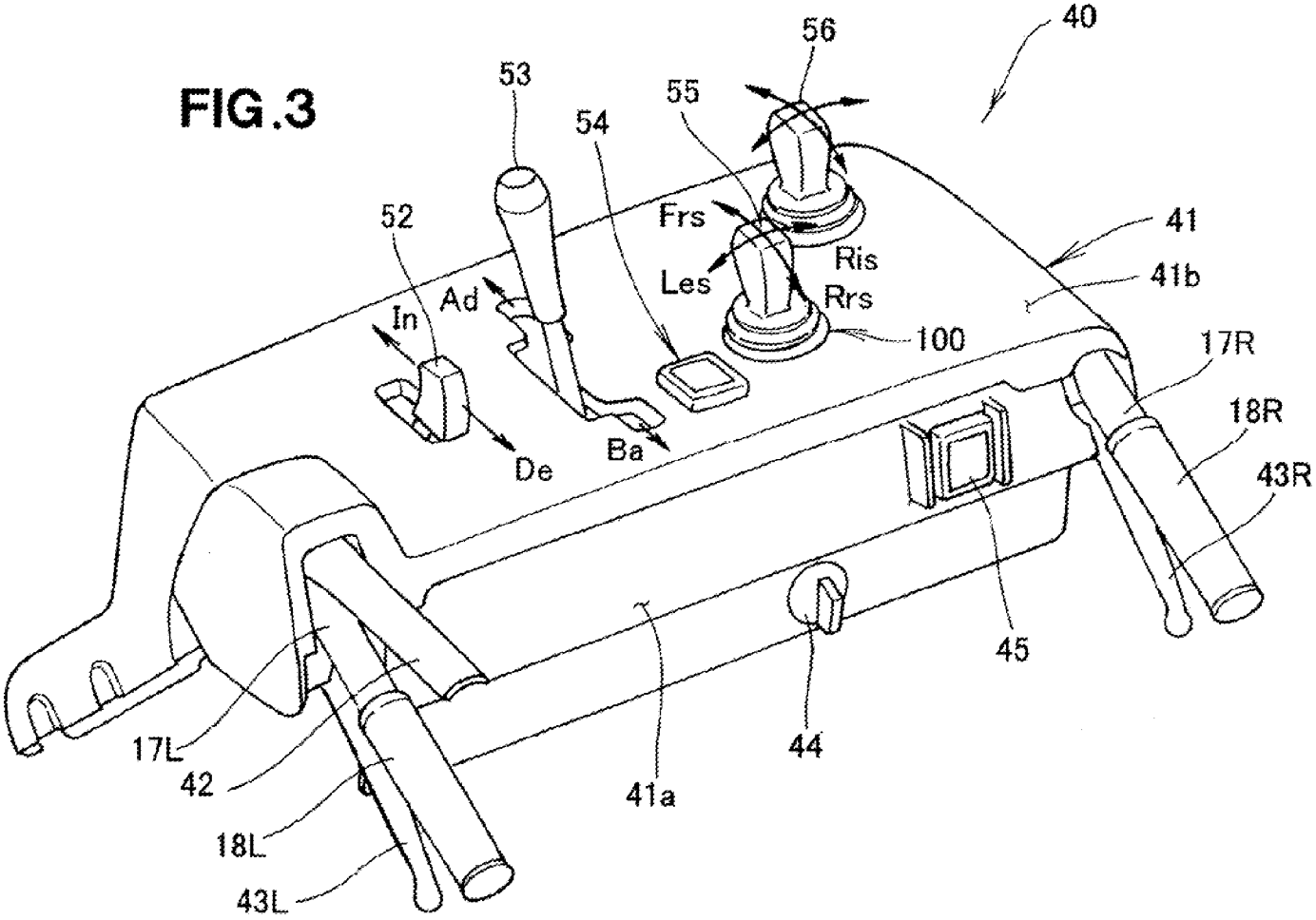
FIG. 3 is a perspective view of an operation section shown in FIG. 1.

The operation section 40, control section 61 and battery 62 are provided between the left and right operating handles 17L and 17R, as noted above. As shown in FIG. 3, the operation section 40 includes: the operation box 41 provided between the left and right operating handles 17L and 17R; a preparing-for-travel lever 42 mounted on the left operating lever 17L near the left grip 18L; and a turning operation lever 43R mounted on the right operating lever 17R near the right grip 18R.

The preparing-for-travel lever 42 is a travel-enabling member that acts on a switch 42*a* (FIG. 2). The switch 42*a* is turned off in response to the preparing-for-travel lever 42 being shifted to a released or free state by a pulling action of a return spring. On the other hand, the switch 42*a* is turned on in response to the human operator gripping and depressing the preparing-for-travel lever 42 toward the grip 18L with its left hand.

The left and right turning operation levers 43L and 43R are members operable with left and right hands of the human operator, gripping the left and right grips 18L and 18R, respectively, for turning the snow removal machine. The left and right turning operation levers 43L and 43R constitute a mechanism that acts on left and right turning switches 43La and 43Ra (FIG. 2).

The left and right turning switches 43La and 43Ra are each turned off in response to the corresponding turning switch 43La or 43Ra being shifted to a released or free state by a pulling action of a return spring. More specifically, the left turning switch 43La is turned on in response to the human operator gripping and raising the left turning lever 43L toward the grip 18L, and similarly, the right turning switch 43Ra is turned on in response to the human operator gripping and raising the right turning lever 43R toward the grip 18R. Thus, whether or not the left and right turning operation levers 43L and 43R are being gripped can be detected by ON/OFF states of the left and right turning switches 43La and 43Ra.

Referring also to FIG. 2, the operation box 41 includes, on its back surface 41*a* (i.e., surface closer to the human operator), a main switch 44 and an auger switch 45 (also referred to as "clutch operation switch 45"). Turning on the main switch 44 can activate the engine 44. The auger switch 45 is a manual switch, such as a push button switch, for turning on/off the clutch operation switch 45.

Further, the operation box 41 includes, on its upper surface 41*b*, a throttle lever 52, a direction-speed operation lever 53, a reset switch 54, an auger housing posture operation lever 55, and a shooter operation lever 56.

The throttle lever 52 controls the number of rotations of the engine 14. The direction-speed operation lever 53 is an operation member for controlling rotations of the electric motors 21L and 21R, details of which will be described later.

The reset switch 54, which may be referred to also as "automatic auger's initial position returning switch 54", is a manual switch, such as a push button, for returning the posture (position) of the auger housing 25 to a preset initial posture (position). The reset switch 54 is a so-called automatic-return type switch that is kept in an ON state while it is being pushed with a finer or hand of the human operator, and it is turned off by automatically returning to an initial or pre-push position by means of biasing force of a return spring upon release of the finer or hand from the reset switch.

The auger housing posture operation lever 55 is an operation member for changing the posture of the auger housing 25. Namely, the auger housing posture operation lever 55 is an operation member for operating the lifting/lowering drive mechanism 16 and the rolling drive mechanism 65. Further, the shooter operation lever 56 is an operation member for changing an orientation of the shooter 33 (FIG. 1).

Figure 4:
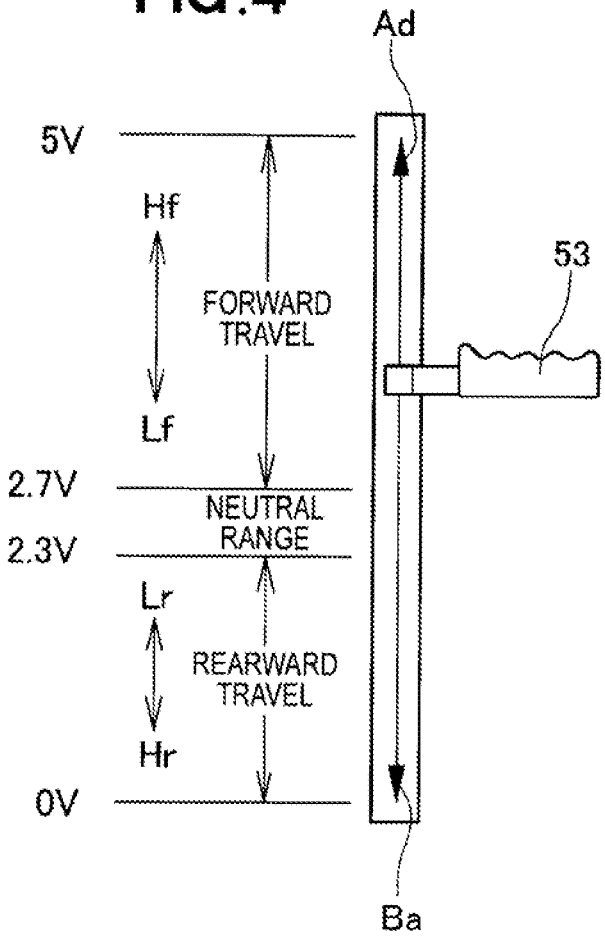
FIG. 4 is a diagram explanatory of operation of a direction-speed lever shown in FIG. 2.

As shown in FIG. 4, the direction-speed operation lever 53, which will be referred to also as "forward/rearward speed adjustment lever 53", can be moved reciprocatively in forward and rearward directions with a hand of the human operator as indicated by arrows Ad and Ba. More specifically, the snow removal machine 10 can be caused to travel forward by the human operator pivoting the direction-speed operation lever 53 to a position in a "forward travel" range forward of a "neutral range", and in the "forward travel" range, speed control can be performed such that the snow removal machine 10 can travel forward at a speed between a low forward travel speed Lf and a high forward travel speed Hf. Similarly, the snow removal machine 10 can be caused to travel rearward by the human operator pivoting the direction-speed operation lever 53 to a position in a "rearward travel" range rearward of the "neutral range", and in the "rearward travel" range, speed control can be performed such that the snow removal machine 10 can travel rearward at a speed between a low rearward travel speed Lr and a high rearward travel speed Hr.

In the illustrated embodiment, voltages corresponding to various positions of the direction-speed operation lever 53 are generated via a potentiometer 53*a* (FIG. 2) in such a manner that 0 (zero) V (volt) corresponds to a maximum rearward travel speed, 5 V corresponds to a maximum forward travel speed, and 2.3 V to 2.7 V corresponds to the neutral range. In this way, the single direction-speed operation lever 53 can adjustably set both a desired one of the forward and rearward travel directions and a desired forward or rearward travel speed of the snow removal machine 10.

Now, a control system of the snow removal machine 10 will be described with reference to FIG. 2. The control system of the snow removal machine 10 includes the control section 61 as its main control component. The control section 61 has a memory 63 incorporated therein for storing various information, and it performs various control by reading out the various information from the memory 63.

The control section 61 further includes a frame inclination angle detection section 64 for detecting an inclination angle of the travel unit frame 12 relative to a ground surface Gr (FIG. 1) which the travel units 11L and 11R are contacting. For example, the frame inclination angle detection section 64 is integrated on a substrate together with other electronic circuits of the control section 61, and thus, the frame inclination angle detection section 64 can be significantly reduced in size and cost.

As shown in FIG. 1, the left and right operating handles 17L and 17R extend obliquely rearward and upward from a rear end portion of the travel unit frame 12 having the left and right travel units 11L and 11R mounted thereon. The control section 61 is provided on the left and right operating handles 17L and 17R and includes the frame inclination angle detection section 64. Such a configuration is substantively the same as where the frame inclination angle detection section 64 is provided directly on the travel unit frame 12. Note that the frame inclination angle detection section 64 may be provided directly on the travel unit frame 12.

The frame inclination angle detection section 64 comprises, for example, an acceleration sensor. This acceleration sensor is, for example, a three-axis acceleration sensor capable of detecting acceleration in three axial directions, i.e. X-, Y- and Z-axis directions, and such a three-axis acceleration sensor may be a conventional sensor called "semiconductor acceleration sensor". Example types of such a semiconductor acceleration sensor include a piezo-resistance type, electrostatic capacitance type, heat detection type, etc.

The above-mentioned three-axis acceleration sensor is capable of detecting acceleration in the three axial directions occurring in the travel unit frame 12 itself. More specifically, the acceleration in the X-axis direction is acceleration produced in the travel unit 12 itself in the vertical direction, i.e. gravitational acceleration, the acceleration in the Y-axis direction is acceleration produced in the travel unit 12 itself in the left-right horizontal direction, and the acceleration in the Z-axis direction is acceleration produced in the travel unit 12 itself in the front-rear horizontal direction.

Such acceleration produced in the travel unit frame 12 itself is detected by the aforementioned acceleration sensor, and an inclination angle of the travel unit frame 12 itself can be obtained on the basis of the detected acceleration values. This is why the frame inclination angle detection section 64 in the instant embodiment includes the acceleration sensor.

An electric power generator 81 is driven by a portion of the output of the engine 14, and electric power thus output from the electric power generator 81 is supplied to the battery 62 but also to the left and right electric motors 21L and 21R and other electric components of the snow removal machine 10. The remaining portion of the engine 14 is used to rotate the auger 31 and the blower 32.

The electromagnetic clutch 35 is turned on in response to the human operator gripping the preparing-for-travel lever 42 and operating the auger switch 45, so that the auger 31 and the blower 32 can be rotated by the power of the engine 14. The electromagnetic clutch 35 can be turned off by the human operator releasing the preparing-for-travel lever 42 or operating the auger switch 45.

Next, behavior of the travel units 11L and 11R and related components will be described. The snow removal machine 10 includes left and right electromagnetic brakes 82L and 82R that function like parking brakes of conventional vehicles. More specifically, the rotation shafts of the left and right electric motors 21L, 21R are braked by the electromagnetic brakes 82L and 82R, respectively. During parking of the snow removal machine 10, the electromagnetic brakes 82L, 82R are in a braking (or ON) state under control of the control section 61. The electromagnetic brakes 82L, 82R can be brought to a non-braking (or OFF) or released state in the following manner.

The electromagnetic brakes 82L, 82R are brought to the OFF or released state once the human operator shifts the direction-speed operation lever 53 to the forward or rearward travel range while the main switch 44 is in the ON state and the preparing-for-travel lever 42 is being gripped by the human operator.

The control section 61 is supplied with information about the current position of the direction-speed operation lever 53 from the potentiometer 53*a*, in accordance with which the control section 61 drives the left and right electric motors 21L and 21R to rotate via left and right motor drivers 84L and 84R. Then, the control section 61 detects rotating speeds of the electric motors 21L and 21R and performs feedback control, on the basis of detection signals of the rotating speeds of the electric motors 21L and 21R, such that the rotating speeds of the electric motors 21L and 21R assume predetermined values. As a consequence, the snow removal machine 10 can travel with the left and right driving wheels 23L, 23R rotating in a desired direction and at desired speeds.

Braking operation during travel of the snow removal machine 10 is executed in the following manner. Each of the motor drivers 84L and 84R includes a regenerative brake circuit 85L or 85R and a short brake circuit 86L or 86R. The short brake circuits 86L and 86R constitute a brake means.

As long as the human operator grips the left turning operation lever 43L and keeps the corresponding turning switch 43La in the ON state, the control section 61 can keep activated the left regenerative brake circuit 85L to thereby lower the rotating speed of the left electric motor 21L. Similarly, as long as the human operator grips the right turning operation lever 43R and keeps the corresponding turning switch 43Ra in the ON state, the control section 61 can keep activated the right regenerative brake circuit 85R to thereby lower the rotating speed of the right electric motor 21R. Namely, the snow removal machine 10 can be turned left as long as the left turning operation lever 43L is gripped by the human operator. Similarly, the snow removal machine 10 can be turned right as long as the right turning operation lever 43R is gripped by the human operator. In this way, the travel of the snow removal machine 10 can be terminated by the human operator performing any one of operations of (1) releasing the preparing-for-travel lever 42, (2) turning off the main switch 44, i.e. returning the main switch 44 to the OFF position, and (3) returning the direction-speed operation lever 53 to a position in the neutral range (i.e., neutral position).

Figure 5:
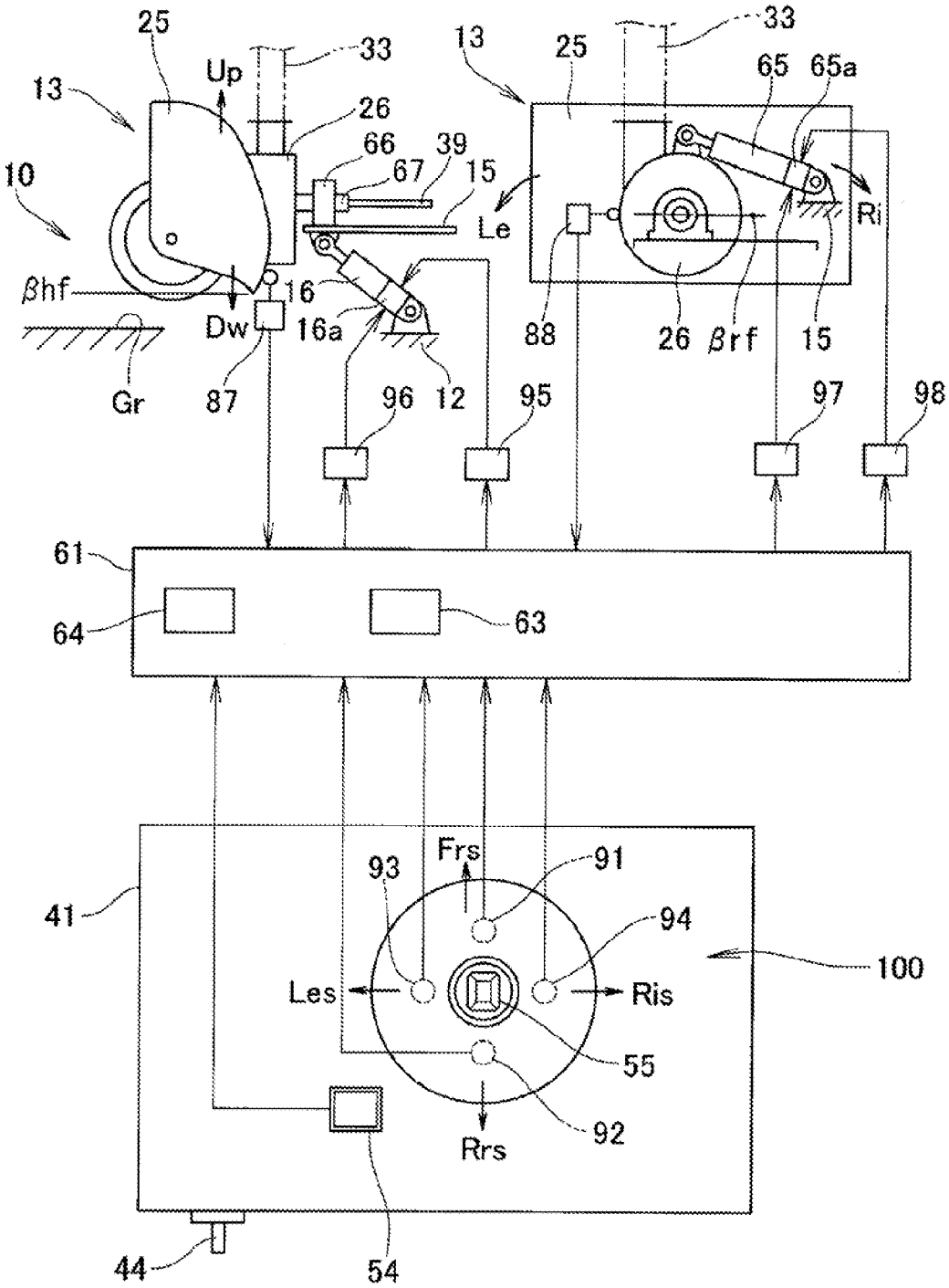
FIG. 5 is a schematic diagram showing relationship between a housing posture control section and a snow removal work section shown in FIG. 2.

The following describe in detail, with reference to FIG. 5, relationship between the snow removal work section 13 and the auger housing posture operation lever 55 shown in FIG. 2. A housing posture operation section 100 is comprised of the auger housing posture operation lever 55 and four auger-housing-posture operating switches 91 to 94.

The lowering switch 91 is turned on in response to the human operator pivoting the auger housing posture operation lever 55 in the forward direction as indicated by arrow Frs. The control section 61 is supplied with an ON signal from the lowering switch 91, in response to which the control section 61 turns on a lowering relay 95 and supplies electric power to the electric motor 16*a* to rotate the electric motor 16*a* in a predetermined forward rotational direction. Thus, the lifting/lowering drive mechanism 16 lowers, or displaces in a direction indicated by arrow Dw, the auger housing 25 and the blower case 26.

The lifting switch 92 is turned on in response to the human operator pivoting the auger housing posture operation lever 55 in the rearward direction as indicated by arrow Rrs. The control section 61 is supplied with an ON signal from the lifting switch 92, in response to which the control section 61 turns on a lifting relay 96 to supply electric power so as to the electric motor 16*a* to rotate the electric motor 16*a* in a reverse rotational direction. Thus, the lifting/lowering drive mechanism 16 lifts, or displaces in a direction indicated by arrow Up, the auger housing 25 and the blower case 26.

Further, the left rolling switch 93 is turned on in response to the human operator pivoting the auger housing posture operation lever 55 in the leftward direction as indicated by arrow Les. The control section 61 is supplied with an ON signal from the left rolling switch 93, in response to which the control section 61 turns on a left rolling relay 97 and supplies electric power to the electric motor 65*a* to rotate the electric motor 65*a* in a predetermined forward rotational direction. Thus, the lifting/lowering drive mechanism 16 tilts (rolls) the auger housing 25 and the blower case 26 in the leftward direction as indicated by arrow Le.

Furthermore, the right rolling switch 94 is turned on in response to the human operator pivoting the auger housing posture operation lever 55 in the rightward direction as indicated by arrow Ris. The control section 61 is supplied with an ON signal from the right rolling switch 94, in response to which the control section 61 turns on a right rolling relay 98 and supplies electric power to the electric motor 65*a* to rotate the electric motor 16*a* in a reverse rotational direction. Thus, the lifting/lowering drive mechanism 16 tilts (rolls) the auger housing 25 and the blower case 26 in the rightward direction as indicated by arrow Ri.

Namely, in response to the human operator pivoting the auger housing posture operation lever 55 in the forward or rearward direction, the electric motor 16*a* rotates in the forward or reverse rotational direction, so that the piston of the lifting/lowering drive mechanism 16 projects or retracts. As a consequence, the auger housing 25 and the blower case 26 are lifted or lowered (i.e., ascends or descends). A lifted/lowered position (i.e., height position) of the auger housing 25 is detected by a height position sensor 87, and a signal indicative of the detected height position is supplied from the height position sensor 87 to the control section 61.

Further, in response to the human operator pivoting the auger housing posture operation lever 55 in the leftward or rightward direction, the electric motor 65*a* rotates in the forward or reverse rotational direction, so that the piston of the rolling drive mechanism 65 projects or retracts. As a consequence, the auger housing 25 and the blower case 26 are rolled leftward or rightward. A position, in the rolling direction, of the auger housing 25 (i.e., rolling position of the auger housing 25) is detected by a rolling position sensor 88, and a signal indicative of the detected rolling position is supplied from the rolling position sensor 88 to the control section 61.

Figure 6:
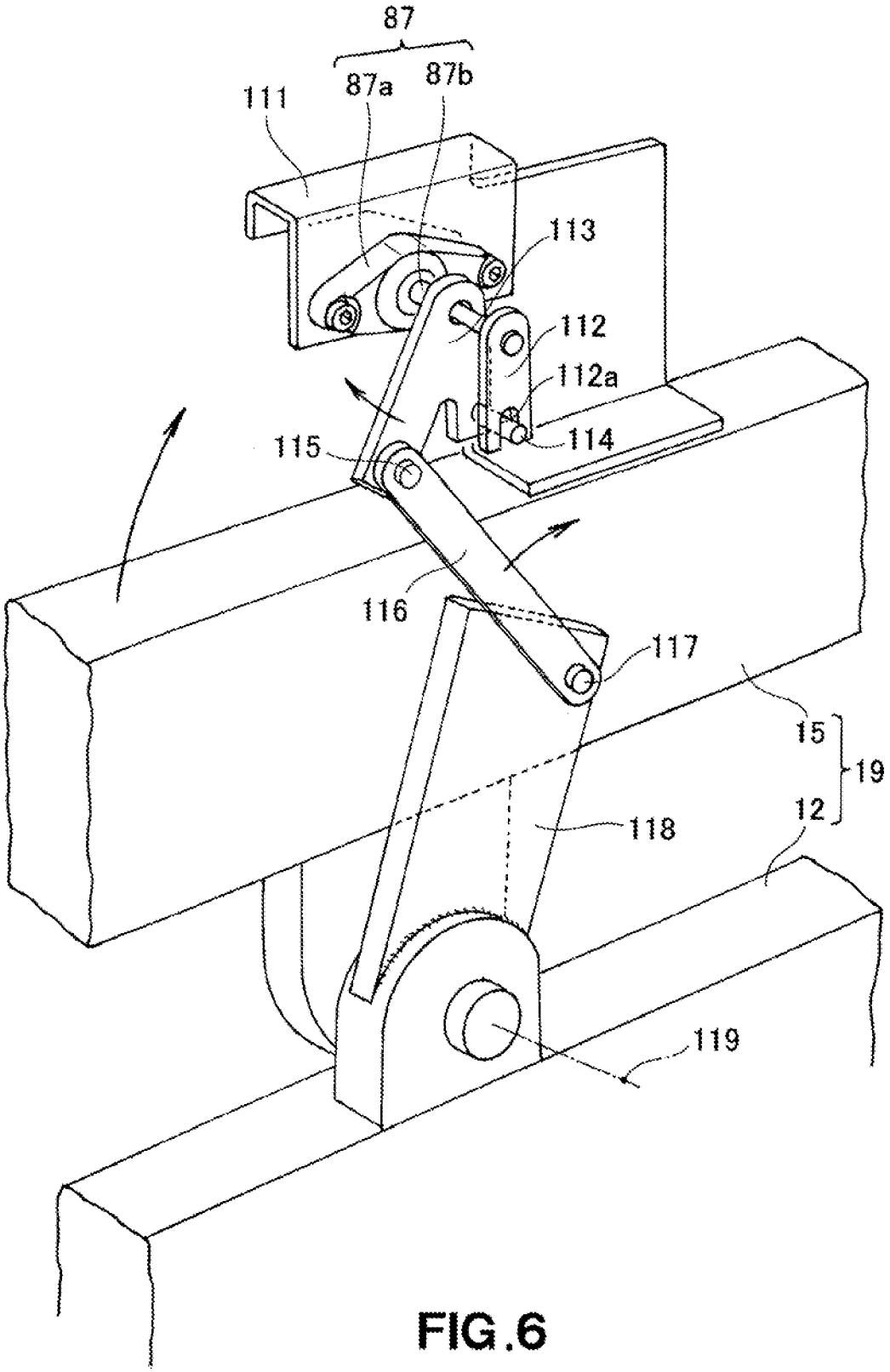
FIG. 6 is a side perspective view showing how a height position sensor shown in FIG. 5 is assembled.

More specifically, as shown in FIG. 6, the height position sensor 87 (i.e., first housing inclination angle detection section 87) detects a vertical inclination angle of the auger housing 25 relative to the travel unit frame 12, and the height position sensor 87 (i.e., first housing inclination angle detection section 87) comprises, for example, a waterproof rotational potentiometer.

The height position sensor 87 has a case 87*a* fixedly mounted on the vehicle body frame 15 via an upper bracket 111. Namely, the height position sensor 87 is provided on a part of the snow removal machine 10 that never makes rolling motion together with the auger housing 25, e.g. on the vehicle body frame 15 that is a part of the machine body 19.

The height position sensor 87 has an input shaft 87*b* rotatably supported on the case 87*a* and extending from the case 87*a* in a vehicle with direction. A resistance value of a variable resistor (not shown) incorporated in the case 87*a* changes in response to relative rotation of the input shaft 87*b* to the case 87*a*. A swing arm 112 extending downward is mounted integrally on the input shaft 87*b* so that it is pivotable in the front-rear direction together with the input shaft 87*b*. The swing arm 112 has a groove 112*a* formed in its distal end and elongated in a longitudinal direction of the swing arm 112. Alternatively, the groove 112*a* may be a through-hole elongated in the longitudinal direction of the swing arm 112.

Further, a first link arm 113 is supported on the input shaft 87*b* in such a manner that it is rotatable relative to the latter. More specifically, the first link arm 113 is pivotable in the front-rear direction relative to the input shaft 87*b*. The first link arm 113 is a member having a generally inverted V shape, and it is supported at its proximal end portion of the inverted V shape on the input shaft 87*b*. A first pin 114 extending horizontally laterally from one of distal end portions of the inverted V shape is engaged in the above-mentioned elongated groove 112*a* of the swing arm 112, and a second pin 115 extending horizontally laterally from the other of the distal end portions of the inverted V shape is connected to one end portion of a second link arm 116 in such a manner that it is rotatable relative to the second link arm 116. The second link arm 116 is pivotable in the front-rear direction relative to the first link arm 113, and the second pin 115 is located forward of the first pin 114.

The second link arm 116 is connected at its other end portion to the travel unit frame 12 by a third pin 117 via a lower bracket 118 in such a manner that it is pivotable in the front-rear direction. The lower bracket 118 extends obliquely rearward and upward away from a pivot point 119 about which the vehicle body frame 15 is pivotable relative to the travel unit frame 12. The first pin 14 and the input shaft 87*b* are arranged substantially in vertical alignment with the third pin 117. A distance from the input shaft 87*b* to the second pin 115 is greater than a distance from the input shaft 87*b* to the first pin 114.

As a front portion of the vehicle body frame 15 extending substantially horizontally angularly moves upward, the case 87*a* of the height position sensor 87 pivots upward, and the input shaft 87*b* too angularly moves in the same direction together with the case 87*a*. However, an amount of pivoting movement of the first link arm 113 is limited by the first pin 114, first link arm 113, second pin 115, second link arm 116 and third pin 117, and thus, a relative rotational angle of the input shaft 87*b* to the case 87*a* increases. Then, as the front portion of the vehicle body frame 15 pivots downward, the relative rotational angle of the input shaft 87*b* to the case 87*a* decreases. A variation amount of the rotational angle of the input shaft 87*b* can be made smaller than a variation amount of the vertical pivoting movement of the vehicle body frame 15.

As shown in FIG. 7, the rolling position sensor 88 (second housing inclination angle detection section 88) is provided for detecting an inclination angle, in the left-right direction, of the auger housing 25 relative to the vehicle body frame 15, and it comprises, for example, a waterproof rotational potentiometer. With such arrangements, the vehicle body frame 15 can be prevented from inclining in the left-right direction relative to the travel unit frame 12. Thus, it may be said that the rolling position sensor 88 detects an inclination angle, in the left-right direction, of the auger housing 25 relative to the travel unit frame 12.

The case 88*a* of the rolling position sensor 88 is fixedly mounted on a front end portion of the vehicle body frame 15 via a bracket 121. Like the aforementioned height position sensor 87, the rolling position sensor 88 is provided on a part of the snow removal machine 10 that never makes rolling motion together with the auger housing 25, e.g. on the vehicle body frame 15 that is a part of the machine body 19.

The rolling position sensor 88 has an input shaft 88*a* rotatably supported on the case 88*a* and extending from the case 88*a* in the rearward direction. A resistance value of a variable resistor (not shown) incorporated in the case 88*a* changes in response to relative rotation of the input shaft 88*b* to the case 88*a*. A swing arm 122 extends in the vehicle width direction and is mounted integrally on the input shaft 88*b* so that it is pivotable in the vertical or up-down direction together with the input shaft 88*b*. The swing arm 122 has a groove 122*a* formed in its distal end and elongated in a longitudinal direction of the swing arm 122. Alternatively, the groove 122*a* may be a through-hole elongated in the longitudinal direction of the swing arm 122.

Further, a link arm 123 is supported on the bracket 121 fixedly mounted on the front end portion of the vehicle body frame 15 in such a manner that it is pivotable clockwise and counterclockwise. The link arm 123 is a member having a substantially L shape as viewed from the back, and it is supported at its proximal end portion (corner portion) of the L shape on a support pin 124 extending rearward from the bracket 121. A pin 125 provided on one of distal end portions of the L-shaped link arm 123 is engaged in the above-mentioned elongated groove 122*a* of the swing arm 122, and the other of the distal end portions of the L-shaped link arm 123 extends downward and has a groove 123*a* formed in its lower end and elongated in a longitudinal direction of the other distal end portion. Alternatively, the groove 123*a* may be a through-hole elongated in the longitudinal direction of the other distal end portion of the L-shaped link arm 123.

The support pin 124 is located in horizontal alignment with the input shaft 88*b* in the vehicle width direction and located immediately above the rotation support section 67. A bar 126 elongated in the front-rear direction is provided on an outer peripheral portion of the rotation support section 67, and the groove 123*a* formed in the other distal end portion of the other distal end portion of the L-shaped link arm 123 is held in engagement with the bar 126. A distance from the input shaft 88*b* to the pin 125 is smaller than a distance from the support pin 124 to the pin 125. Further, a distance from the support pin 124 to the bar 126 is substantially equal to the distance from the support pin 124 to the pin 125.

As the auger housing 25 rolls leftward or rightward relative to the vehicle body frame 15, the rotation support section 67 and the bar 126 roll in the same direction as the auger housing 25. As a consequence, the link arm 123 pivots about the support pin 124 to thereby pivot the input shaft 88*b* via the pin 125 and the swing arm 122, so that the rotational angle of the input shaft 88*b* relative to the case 88*a* increases. Then, as the auger housing 25 rolls back to the previous position, the rotational angle of the input shaft 88*b* relative to the case 88*a* decreases. Thus, a variation amount of the rotational angle of the input shaft 88*b* can be made smaller than a variation amount of the auger housing 25 in the rolling direction.

During snow removal work by the snow removal machine 10, vibrations occurring in the auger 31 and the blower 32 transmit to the auger housing 25 and the blower case 26. If the vibrations transmit from the auger housing 25 and the blower case 26 to the height position sensor 87 and the rolling position sensor 88, they would adversely influence durability of the height and rolling position sensors 87 and 88.

To prevent the vibrations from transmitting the from the auger housing 25 and the blower case 26 to the sensors 87 and 88, the sensors 87 and 88 are provided on parts of the snow removal machine 10 that never make rolling motion together with the auger housing 25, e.g. on the vehicle body frame 15 that is a part of the machine body 19. With such an arrangement, it is possible to prevent vibrations and impacts from transmitting from the auger housing 25 and the blower case 26 directly to the sensors 87 and 88 and thereby increase the durability of the sensors 87 and 88.

Next, with reference to FIGS. 8 to 14 and FIGS. 2 and 5 as well, a description will be given about control flows executed in a case where the control section 61 (FIG. 2) in the instant embodiment is implemented by a microcomputer. For example, the control flows are started up upon turning-on of the main switch 44 and brought to an end upon turning-off of the main switch 44. Note that control flow charts shown in FIGS. 8 to 14 are explanatory only of step operations related to rolling control and height control of the auger housing 25 in the embodiment of the snow removal machine 10 with the other step operations omitted.

Figure 8:
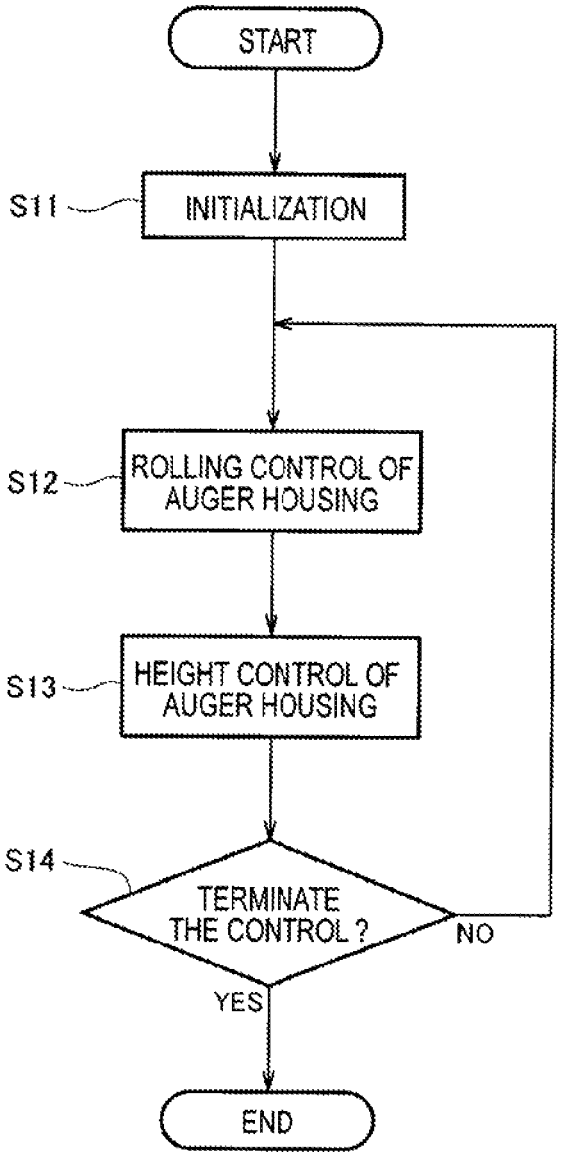
FIG. 8 is a flow chart of an example main control flow executed by a control section shown in FIG. 2.

FIG. 8 is a flow chart showing an example main control flow executed by the control section 61 in the instant embodiment of the snow removal machine 10. First, at step S11, predetermined initialization is performed for resetting various settings and flags to respective initial values. Then, rolling control is performed on the auger housing 25 at step S12, and height control is performed on the auger housing 25 at step S13. Note that the execution order of steps S12 and S13 may be reversed. A specific control flow of the rolling control will be discussed later with reference to FIGS. 11 and 12, and a specific control flow of the height control will be discussed later with reference to FIGS. 13 and 14.

At step S14 following step S13, the control section 61 determines whether or not to terminate the main control flow. If the main switch 44 is currently ON, the control section 61 determines that the main control flow is to be continued and then recovers to step S12. If, on the other hand, the main switch 44 is currently OFF, the control section 61 determines that the main control flow is to be discontinued and then discontinues or terminates the main control flow.

Figure 9:
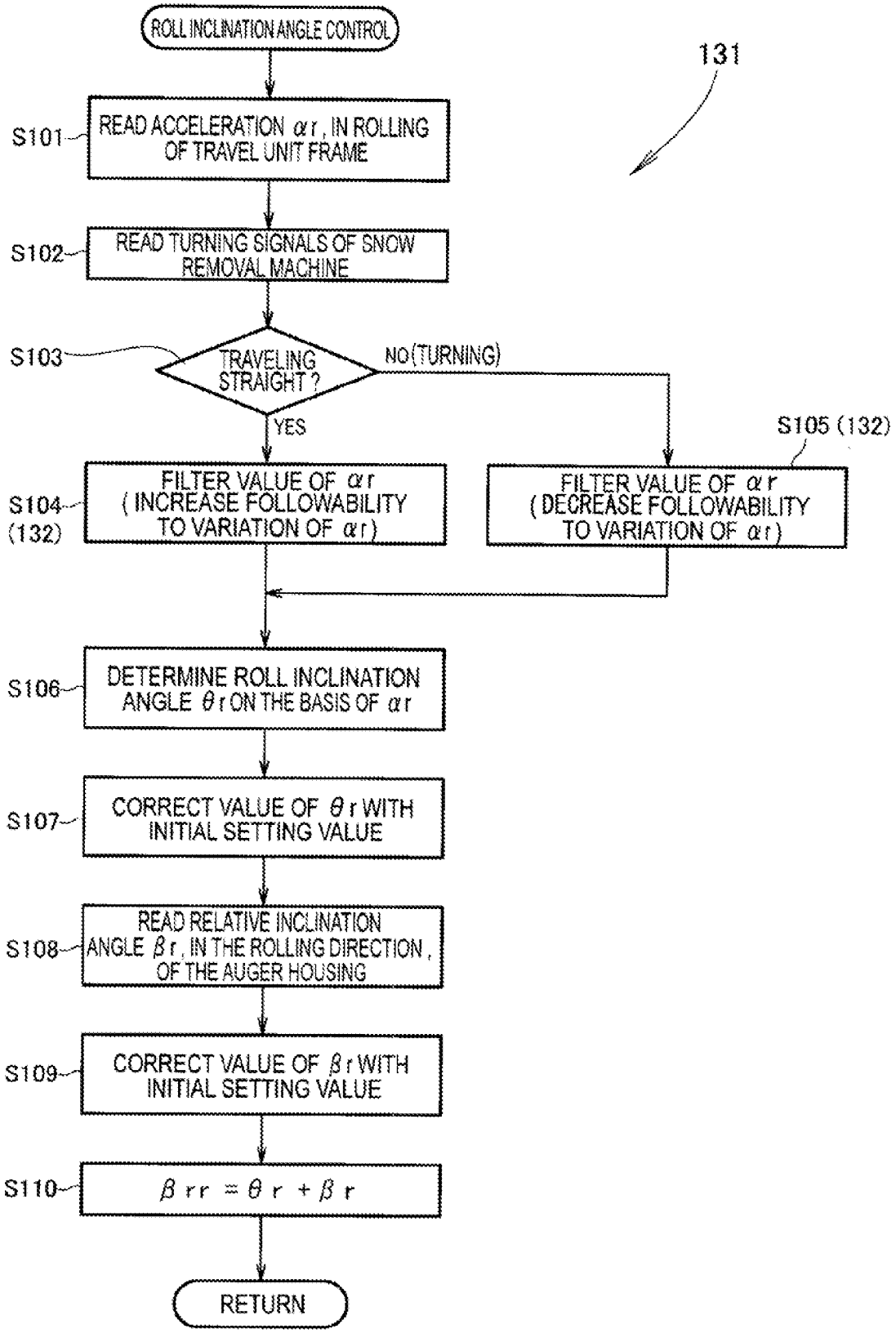
FIG. 9 is a flow chart of a roll inclination angle detection flow executed by the control section shown in FIG. 2.
Figure 10:
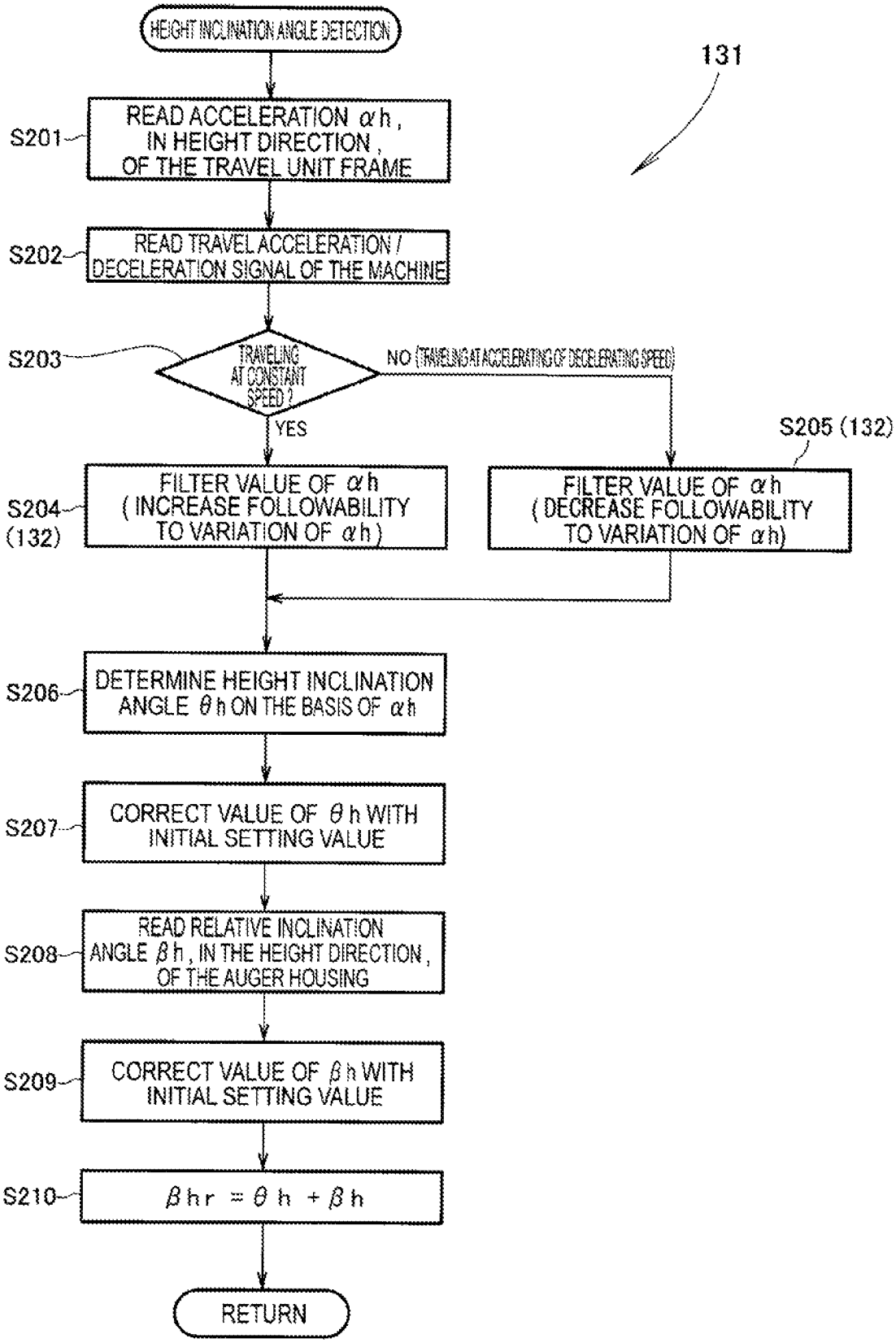
FIG. 10 is a flow chart of a height inclination angle detection flow executed by the control section shown in FIG. 2.

Further, during execution of steps S12 to S14, the control section 61 executes a roll inclination angle detection flow shown in FIG. 9 and a height inclination angle detection flow shown in FIG. 10 per predetermined sampling timing that occurs at minute time intervals, e.g. every several milliseconds.

First, the roll inclination angle detection flow shown in FIG. 9 will be described in detail. Upon startup of the roll inclination angle detection flow, the control section 61 at step S101 reads acceleration $\alpha r$ in the rolling direction of the travel unit frame 12 by reading a value detected by the frame inclination angle detection section 64; thus, the frame inclination angle detection section 64 may be referred to also as "acceleration sensor".

Then, at step S102, the control section 61 reads signals indicative of turning of the snow removal machine 10, i.e. signals output from the left and right turning switches 43La and 43Ra. At next step S103, the control section 61 determines whether the snow removal machine 10 is traveling straight. If the left and right turning switches 43La and 43Ra are each currently OFF, the control section 61 determines that the snow removal machine 10 is traveling straight and thus proceeds to step S104. If any one of the left and right turning switches 43La and 43Ra is currently ON, the control section 61 determines that the snow removal machine 10 is turning (making a left or right turn) and thus branches to step S105.

At step S104, filtering is performed so as to increase followability to a variation in the value of the acceleration $\alpha r$ in the rolling direction. At step S105, on the other hand, filtering is performed so as to decrease the followability to a variation in the value of the acceleration $\alpha r$ in the rolling direction. Such filtering at steps S104 and S105 is effected, for example, by a recursive filter function.

As an example, at steps S104 and S105, arithmetic operations based on arithmetic expression (1) below are performed on an input value αri of the acceleration αr to thereby obtain an output value αro of the acceleration αr. The input value αri is a latest input value of the acceleration αr read at step S101, while the output value αro is a latest output value obtained by execution of steps S104 and S105. Here, k is a filter coefficient that is set as "0<k≤1.0".

$$(\alpha ri-\alpha ro)\cdot k+\alpha ro=\alpha ro \qquad \text{arithmetic expression (1)}$$

At step S104 performed upon determination that the snow removal machine 10 is traveling straight, the filter coefficient k is set at a relatively large value, such as 1.0 or a value approximate to 1.0. Thus, the output value αro becomes a value equal or approximate to the input value αri and can quickly converge to a variation of the input value αri. Therefore, the followability to a variation of the acceleration αr in the rolling direction increases. As a consequence, the output value αro can easily respond to an inclination of the travel unit frame 12 itself and thus can be optimal to the straight travel.

At step S105 performed upon determination that the snow removal machine 10 is turning, on the other hand, the filter coefficient k is set at a value smaller than that at step S104. Thus, the followability to a variation of the acceleration αr in the rolling direction decreases, and the output value αro slowly converges to a variation of the input value αri. Therefore, the output value αro can prevent a malfunction of the snow removal machine 10, without being influenced by a peak value of the input value αri, and is optimal to signal processing during the turning of the snow removal machine 10.

Upon completion of the operation at step S104 or S105, an inclination angle θr in the rolling direction of the travel unit frame 12 itself is determined on the basis of the output value αro of the acceleration αr, at step S106. Such an inclination angle θr in the rolling direction (hereinafter referred to as "roll inclination angle θr") may be determined on the basis of the output value αro, for example, in accordance with an arithmetic expression or a map. In the case where the map is employed for determining the roll inclination angle θr, relationship of roll inclination angles θr with output values αro of the acceleration αr may be set and stored in the memory 63 in advance.

Then, at step S107, the value of the roll inclination angle θr is corrected with an initial setting value θrs. The initial setting value θrs is a specific reference value zero-point corrected for the snow removal machine 10 prior to shipment from a production factory and prestored in the memory. The zero-point correction is made, for example, with the snow removal machine 10 placed on a preset horizontal flat surface. In this manner, an assembly error of the frame inclination angle detection section 64 assembled to the body of snow removal machine 10 can be corrected.

Then, at step S108, the control section 61 reads a relative inclination angle βr, in the rolling direction, of the auger housing 25 relative to the travel unit frame 12 (such a relative inclination angle βr will hereinafter be referred to as "relative roll inclination angle βr") by reading a value detected by the roll position sensor 88.

Then, at step S109, the value of the relative roll inclination angle βr is corrected with an initial setting value βrs. The initial setting value βrs is a specific reference value zero-point corrected individually for the snow removal machine 10 prior to the shipment from the production factory and prestored in the memory 63. The zero-point correction is made, for example, with the snow removal machine 10 placed on the preset horizontal flat surface. In this manner, an assembly error of the rolling position sensor 88 assembled to the body of the snow removal machine 10 can be corrected.

Then, an actual roll inclination angle βrr of the auger housing 25 relative to the ground surface Gr, i.e. an overall inclination angle βrr in the rolling direction, is determined at step S110 on the basis of the roll inclination angle θr corrected at step S107 and the relative roll inclination angle βr corrected at step S109; more specifically, the overall roll inclination angle βrr is determined in accordance with an arithmetic operation of "βrr=θr+βr". After that, the roll inclination angle detection flow is brought to an end.

Next, the height roll inclination angle detection flow shown in FIG. 10 will be described in detail below. Upon startup of the height roll inclination angle detection flow, the control section 61 at step S201 reads acceleration αh of the travel unit frame 12 in the front-rear direction (corresponding to the height direction of the auger housing 25) by reading a value detected by the frame inclination angle detection section 64 (acceleration sensor 64).

Then, at step S202, the control section 61 reads a travel acceleration/deceleration signal of the snow removal machine 10. For this purpose, the control section 61 reads, for example, a signal of the switch 42*a* of the preparing-for-travel lever 42 and a signal of the potentiometer 53*a* of the direction-speed operation lever 53. In response to the human operator shifting the direction-speed operation lever 53 from the "neutral range" to the "forward travel" range, the snow removal machine 10 starts traveling and accelerates. Further, the snow removal machine 10 traveling forward accelerates in response to the human operator shifting the direction-speed operation lever 53 from the low forward travel speed Lf to the high forward travel speed Hf, and it decelerates in response to the human operator shifting the direction-speed operation lever 53 from the high forward travel speed Hf to the low forward travel speed Lf. Further, the snow removal machine 10 decelerates and stops traveling in response to the human operator returning the direction-speed operation lever 53 to the neutral range, and it rapidly decelerates and stops traveling in response to the human operator releasing the preparing-for-travel lever 42.

Then, at step S203, the control section 61 determines whether the snow removal machine 10 is traveling at a constant speed. If the snow removal machine 10 is traveling at a constant speed as determined at step S203, the control section 61 judges that the snow removal machine 10 is traveling straight and proceeds to step S204. If the snow removal machine 10 is traveling at an accelerating speed or at a decelerating speed, on the other hand, the control flow branches to step S205.

At step S204, filtering is performed so as to increase followability to a variation in the value of the acceleration αh in the height direction. At step S205, on the other hand, filtering is performed so as to decrease the followability to a variation in the value of the acceleration αh in the height direction. Specifically, such filtering at steps S204 and S205 is effected, for example, by a recursive filter function.

As an example, at steps S204 and S205, arithmetic operations based on arithmetic expression (2) below are performed on an input value αhi of the acceleration αh to thereby obtain an output value αho of the acceleration αh. The input value αhi is a latest input value of the acceleration αh read at step S201, while the output value αho is the latest output value obtained by execution of steps S204 and S205. Here, k is a filter coefficient that is set as "0<k≤1.0".

$$(\alpha hi-\alpha ho)\cdot k+\alpha ho=\alpha ho \qquad \text{arithmetic expression (2)}$$

At step S204 performed upon determination that the snow removal machine 10 is traveling at a constant speed, the filter coefficient k is set at a relatively large value, such as 1.0 or a value approximate to 1.0. Thus, the output value αho becomes a value equal or approximate to the input value αhi and can quickly converge to a variation of the input value αhi. Therefore, the followability to a variation of the acceleration αh in the height direction increases. As a consequence, the output value αho can easily respond to an inclination of the travel unit frame 12 and thus is optimal during the straight travel.

At step S205 performed upon determination that the snow removal machine 10 is traveling at an accelerating speed, on the other hand, the filter coefficient k is set at a value smaller than that at step S204. Thus, the followability to a variation of the acceleration αh in the height direction decreases, and the output value αho slowly converges to a variation of the input value αhi. Therefore, the output value αho can prevent a malfunction of the snow removal machine 10, without being influenced by a peak value of the input value αhi, and is optimal to signal processing during the accelerating or decelerating travel of the snow removal machine 10.

Upon completion of the operation at step S204 or S205 above, an inclination angle θh in the height direction (corresponding to the height direction of the auger housing 25) of the travel unit frame 12 itself is determined on the basis of the output value αho of the acceleration αh, at step S206. Such an inclination angle θh in the height direction (hereinafter referred to also as "height inclination angle θh") may be determined in accordance with an ordinary arithmetic expression or a map. In the case where the map is employed for determining a height inclination angle θh, relationship of height inclination angles θh with values of acceleration αh may be set and stored in the memory 63 in advance.

Then, at step S207, the value of the height inclination angle θh is corrected with an initial setting value θhs. The initial setting value θhs is a specific reference value zero-point corrected individually for the snow removal machine 10 prior to shipment from the production factory and prestored in the memory 63. The zero-point correction is made, for example, with the snow removal machine 10 placed on a preset horizontal flat surface. In this manner, an assembly error of the frame inclination angle detection section 64 assembled to the body of the snow removal machine 10 can be corrected.

Then, at step S208, the control section 61 reads a relative inclination angle βh, in the height direction, of the auger housing 25 relative to the travel unit frame 12 (such a relative inclination angle βh will hereinafter be referred to also as "relative height inclination angle βh") by reading a value detected by the height position sensor 87.

Then, at step S209, the value of the relative height inclination angle βh is corrected with an initial setting value βhs. The initial setting value βhs is a specific reference value zero-point corrected individually for the snow removal machine 10 prior to the shipment from the production factory and prestored in the memory 63. The zero-point correction is made with the snow removal machine 10 placed on the preset horizontal flat surface. In this manner, an assembly error of the height position sensor 87 assembled to the body of the snow removal machine 10 can be corrected.

Then, an actual height inclination angle βhr of the auger housing 25 relative to the ground surface Gr (horizontal flat surface), i.e. an overall inclination angle βhr in the height direction, is determined at step S210 on the basis of the height inclination angle θh corrected at step S207 and the relative height inclination angle βh corrected at step S209; more specifically, the overall height inclination angle βhr is determined in accordance with an arithmetic operation of "βhr=θr+βr". After that, the height inclination angle detection flow is brought to an end.

Figure 11:
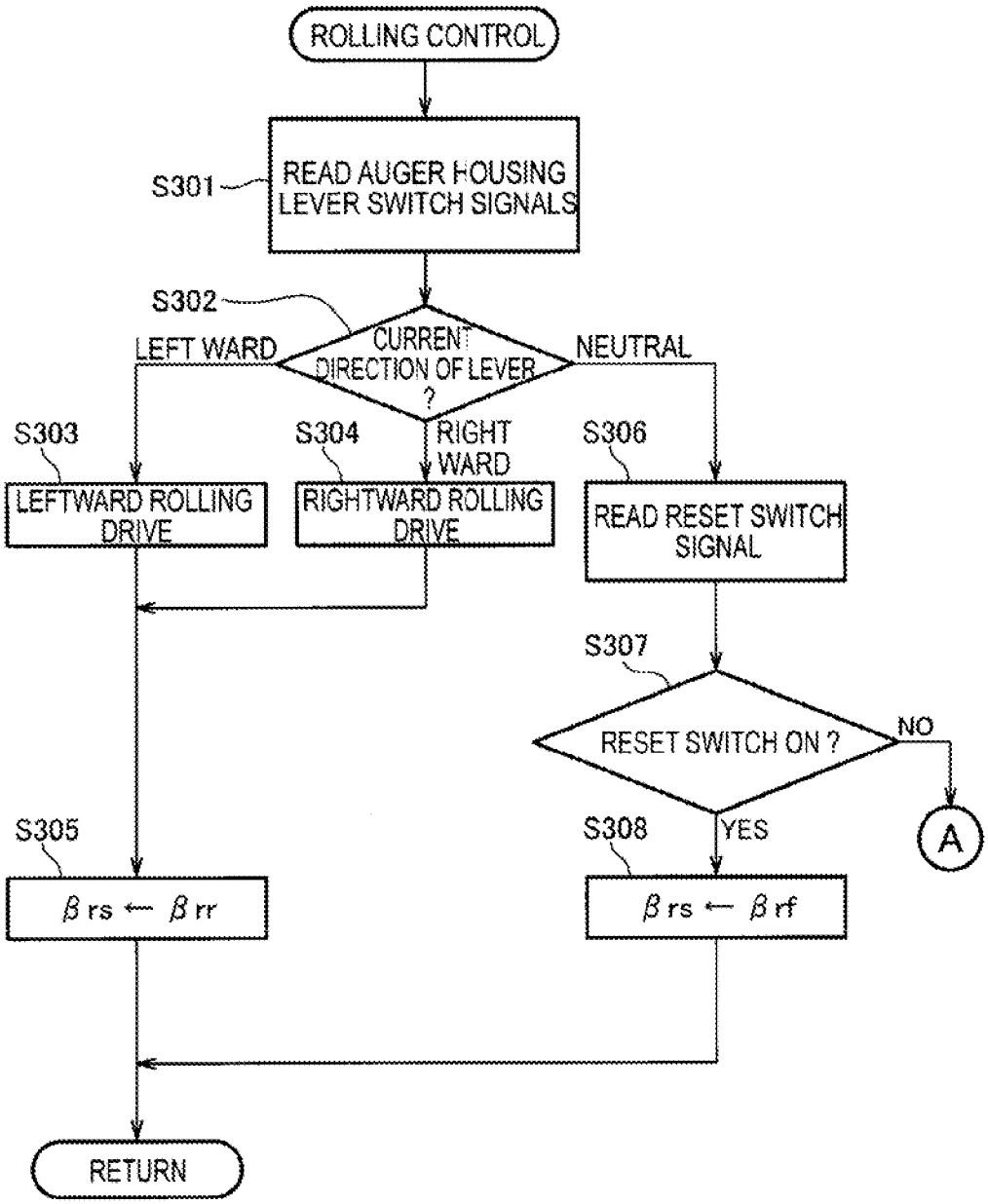
FIG. 11 is a flow chart of a portion of a subroutine at step S12 shown in FIG. 8.
Figure 12:
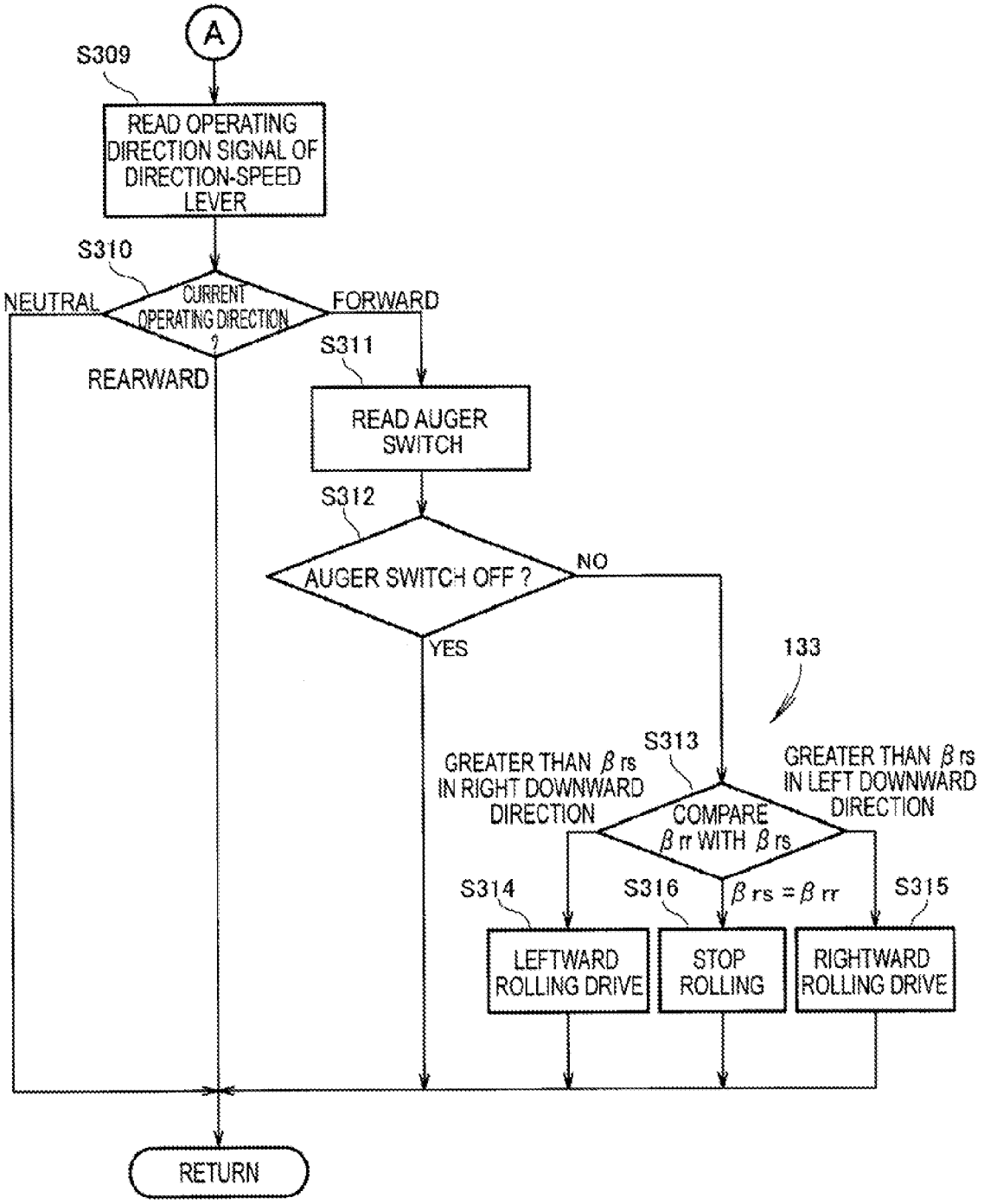
FIG. 12 is a flow chart of the remaining portion of the subroutine shown in FIG. 11.

The following describe, with reference to FIGS. 11 and 12, a specific control flow of the rolling control subroutine performed by the control section 61 at step S12 in FIG. 8.

First, at step S301, the control section 61 reads switch signals (auger housing lever switch signals) output from the four switches 91 to 94 of the housing posture operation section 100 shown in FIG. 5. A current operating direction of the auger housing posture operation lever (posture operation lever) 55 can be identified from these switch signals.

Then, at step S302, the control section 61 determines which one of leftward, rightward and neutral the current operating direction of the posture operation lever 55 is. If the current operating direction of the posture operation lever 55 is the leftward direction as determined at step S302, the control flow proceeds to step S303, where the auger housing 25 and the blower case 26 are inclined or tilted leftward, i.e. driven to roll leftward (leftward rolling drive).

Further, if the current operating direction of the posture operation lever 55 is the rightward direction as determined at step S302, the control flow proceeds to step S304, where the auger housing 25 and the blower case 26 are tilted rightward, i.e. driven to roll rightward (rightward rolling drive).

Upon completion of step S303 and S304, a value of the current actual roll inclination angle βrr (i.e., overall inclination angle βrr in the rolling direction) is set as a target roll angle βrs at step S305, after which the control section 61 terminates the instant subroutine to revert to step S13 of FIG. 8. The current actual roll inclination angle βrr is the value obtained at step S110 of FIG. 9.

Furthermore, if the current operating direction of the posture operation lever 55 is neutral as determined at step S302, the control flow proceeds to step S306, where the control section 61 reads a switch signal of the reset switch 54.

Then, the control section 61 determines at step S307 whether the reset switch 54 is currently ON. If the reset switch 54 is currently ON as determined at step S307, a preset value of the roll inclination angle βrf is set as the target roll angle βrs at step S308, after which the control section 61 terminates the instant subroutine to revert to step S13 of FIG. 8. As noted above, in response to the reset switch 54 being turned on, the rolling drive mechanism 65 returns the posture of the auger housing 25 and the blower case 26 to the left-right horizontal posture or position βrf shown in FIG. 5.

If, on the other hand, the reset switch 54 is currently OFF as determined at step S307, the control flow branches to step S309 shown in FIG. 12, where the control section 61 reads an operating direction signal of the direction-speed operation lever 53. The operating direction signal of the direction-speed operation lever 53 depends on a current position of the direction-speed operation lever 53. Namely, the control section 61 reads a signal supplied from the potentiometer 53*a* of the direction-speed operation lever 53.

Then, at step S310, the control section 61 determines, on the basis of the output of the potentiometer 53*a*, which of the operating directions the direction-speed operation lever 53 is currently in. If the current operating direction of the direction-speed operation lever 53 is "neutral", the control section 61 determines that stop control is to be performed and thus terminates the instant subroutine to revert to step S13 of FIG. 8. If the current operating direction of the direction-speed operation lever 53 is "rearward", the control section 61 determines that rearward travel control is to be performed and thus terminates the instant subroutine to revert to step S13 of FIG. 8. Further, if the current operating direction of the direction-speed operation lever 53 is "forward", the control section 61 determines that forward travel control is to be performed and thus terminates the instant subroutine to revert to step S311 of FIG. 8.

Next, at step S311, the control section 61 reads a switch signal of the auger switch 45. Then, the control section 61 determines at step S312 whether the auger switch 45 is currently ON. If the auger switch 45 is currently OFF as determined at step S312, the control section 61 terminates the instant subroutine to revert to step S13 of FIG. 8. If, on the other hand, the auger switch 45 is currently ON as determined at step S312, the auger 31 and the blower 32 are driven to perform snow removal work, and the control flow proceeds to step S313.

Then, at step S313, the current actual roll inclination angle βrr (overall inclination angle βrr in the rolling direction) is compared with the target roll angle βrs. If the actual roll inclination angle βrr is greater than the target roll angle βrs in a right downward direction as determined at step S313, the control flow goes to step S314, but if the actual roll inclination angle βrr is greater than the target roll angle βrs in a left downward direction as determined at step S313, the control flow goes to step S315.

At step S314, the left rolling relay 97 is turned on so that electric power is supplied to the electric motor 65*a* to rotate the electric motor 65*a* in the forward rotational direction, after which the control section 61 terminates the instant subroutine to revert to step S13 of FIG. 8. Thus, the rolling drive mechanism 65 drives the auger housing 25 and the blower case 26 to tilt (roll) leftward (leftward rolling drive). Such leftward rolling drive by the electric motor 65*a* continues until it is determined that the actual roll inclination angle βrr has equaled the target roll angle βrs.

At step S315, the right rolling relay 98 is turned on so that electric power is supplied to the electric motor 65*a* to rotate the electric motor 65*a* in the reverse rotational direction, after which the control section 61 terminates the instant subroutine to revert to step S13 of FIG. 8. Thus, the rolling drive mechanism 65 drives the auger housing 25 and the blower case 26 to tilt (roll) rightward (rightward rolling drive). Such rightward rolling drive by the electric motor 65*a* continues until it is determined that the actual roll inclination angle βrr has equaled the target roll angle βrs.

If the actual roll inclination angle βrr has equaled the target roll angle βrs as determined at step S313, the control section 61 turns off both of the left and right rolling relays 97 and 98 to deactivate the electric motor 65*a* for stopping rolling at step S316, and then it terminates the instant subroutine to revert to step S13 of FIG. 8.

Figure 13:
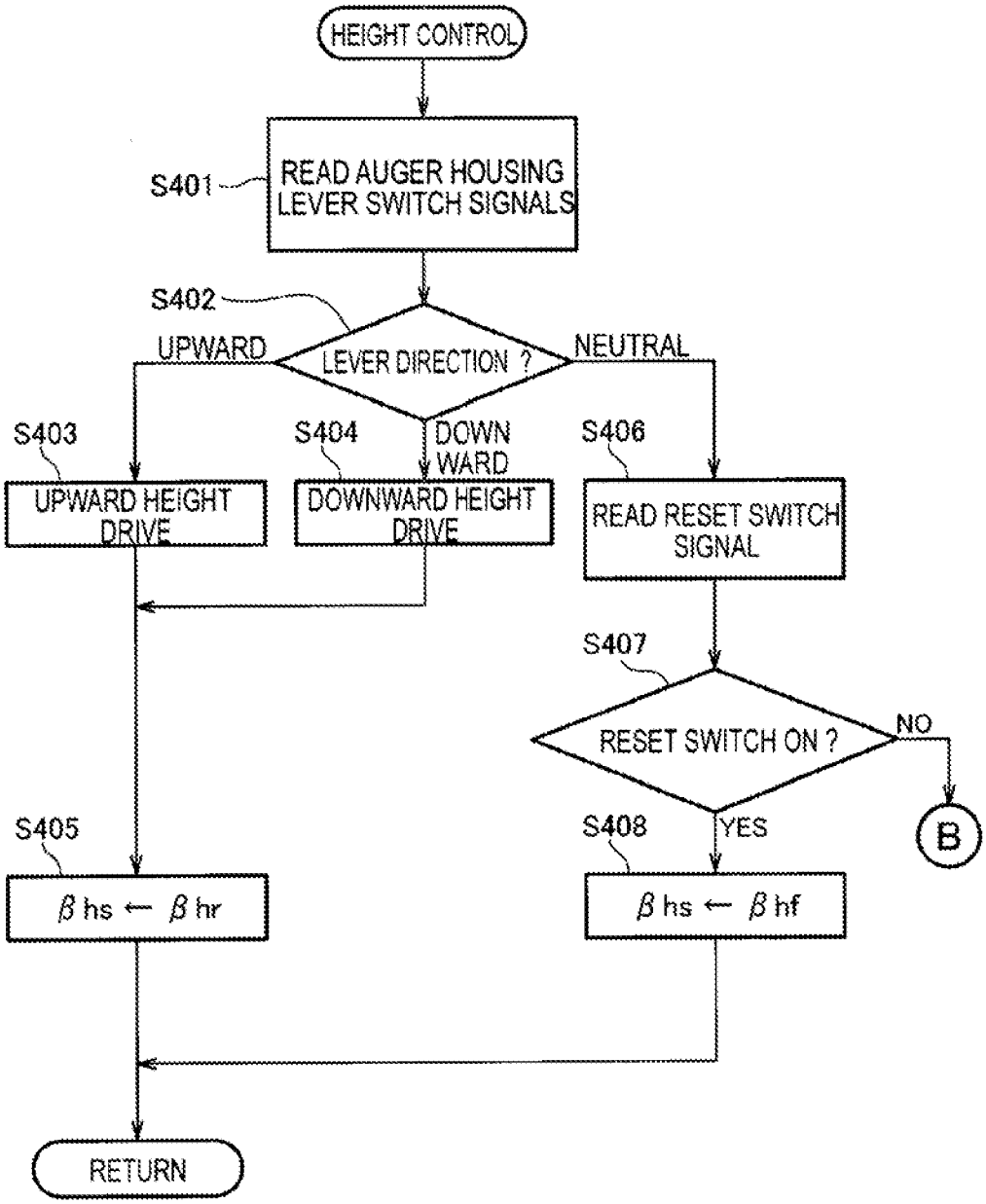
FIG. 13 is a flow chart of a portion of a subroutine at step S13 shown in FIG. 8.
Figure 14:
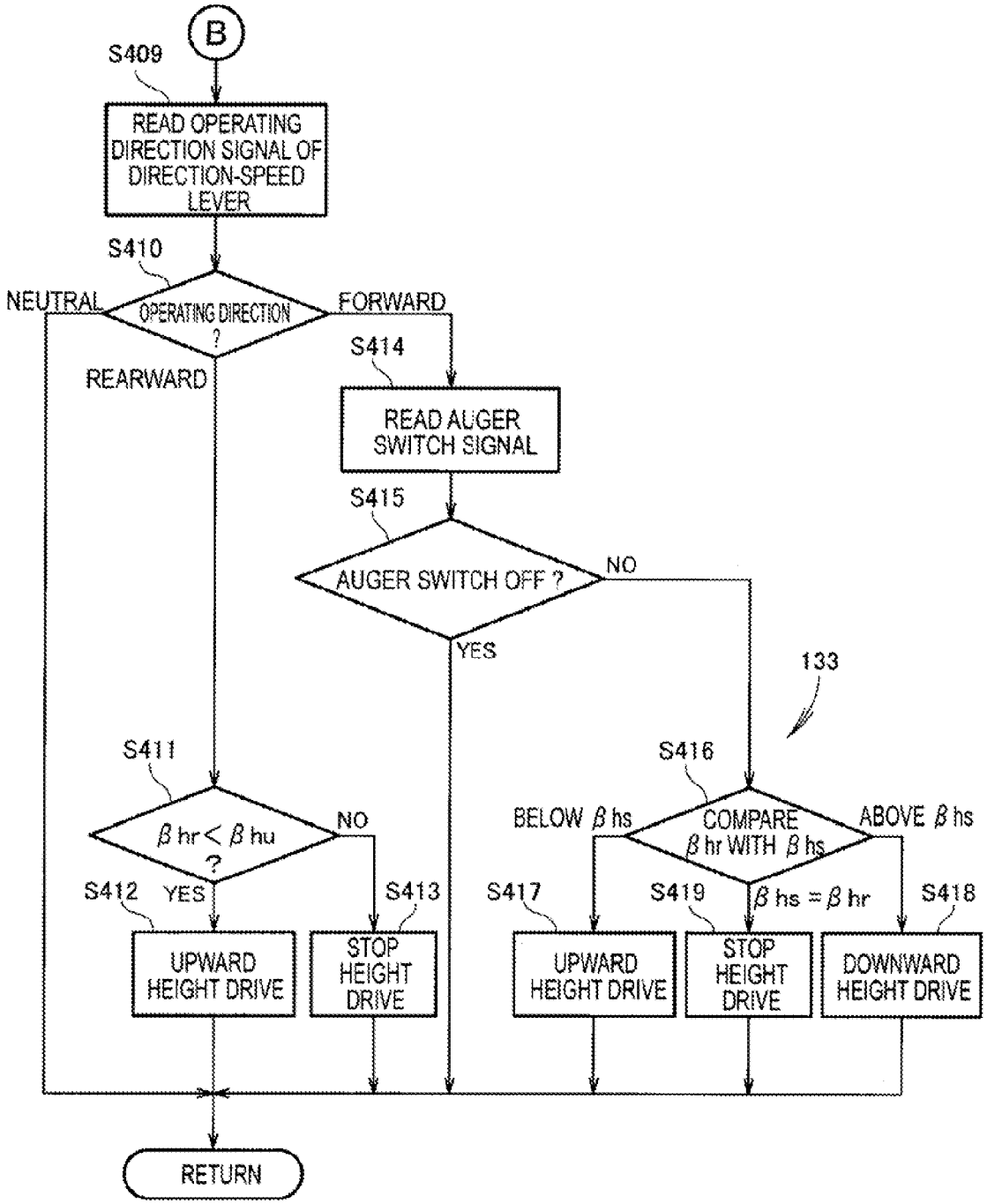
FIG. 14 is a flow chart of the remaining portion of the subroutine shown in FIG. 13.

The following describe, with reference to FIGS. 13 and 14, a specific control flow of the height control subroutine performed by the control section 61 at step S13 in FIG. 8.

First, at step S401, the control section 61 reads switch signals (auger housing lever switch signals) output from the four switches 91 to 94 of the housing posture operation section 100 shown in FIG. 5. A current operating direction of the auger housing posture operation lever (posture operation lever) 55 can be identified from these switch signals.

Then, at step S402, the control section 61 determines which one of upward, downward and neutral the current operating direction of the posture operation lever 55 is. If the current operating direction of the posture operation lever 55 is the upward direction as determined at step S402, the control flow proceeds to step S403, where the auger housing 25 and the blower case 26 are tilted upward (upward height drive).

Further, if the current operating direction of the posture operation lever 55 is the downward direction as determined at step S402, the control flow proceeds to step S404, where the auger housing 25 and the blower case 26 are tilted downward (downward height drive).

Upon completion of step S403 and S404, a value of the current actual height inclination angle βhr is set as a target height inclination angle βhs at step S405, after which the control section 61 terminates the instant subroutine to revert to step S14 of FIG. 8. The current actual height inclination angle βhr is the value obtained at step S210 of FIG. 10.

Furthermore, if the current operating direction of the posture operation lever 55 is neutral as determined at step S402, the control flow proceeds to step S406, where the control section 61 reads a switch signal of the reset switch 54.

Then, the control section 61 determines at step S407 whether the reset switch 54 is currently ON. If the reset switch 54 is currently ON as determined at step S407, a preset value of the height inclination angle βhf is set as the target height inclination angle βhs at step S408, after which the control section 61 terminates the instant subroutine to revert to step S14 of FIG. 8. As noted above, in response to the reset switch 54 being turned on, the lifting/lowering drive mechanism returns the posture of the auger housing 25 and the blower case 26 to a vertical reference height position βhf shown in FIG. 5.

Thus, in a case where snow of a snow mountain is relative hard, it is convenient that the reset switch 54 be turned on to maintain the auger housing 25 in the horizontal posture to thereby execute horizontal stepped cutting.

If the reset switch 54 is currently OFF as determined at step S407, the control flow branches to step S409 of FIG. 14, where the control section 61 reads an operating direction signal of the direction-speed operation lever 53. The operating direction signal of the direction-speed operation lever 53 depends on a current position of the direction-speed operation lever 53. Namely, the control section 61 reads a signal supplied from the potentiometer 53*a* of the direction-speed operation lever 53.

Then, at step S410, the control section 61 determines, on the basis of the signal supplied from the potentiometer 53*a*, which of the operating directions the direction-speed operation lever 53 is currently in. If the current operating direction of the direction-speed operation lever 53 is "neutral", the control section 61 determines that stop control is to be performed and thus terminates the instant subroutine to revert to step S14 of FIG. 8.

If the current operating direction of the direction-speed operation lever 53 is "rearward", the control section 61 determines that rearward travel control is to be performed, and then it determines, at step S411, whether the current actual height inclination angle βhr is smaller than a rearward-travel-height lower limit value βhu. The rearward-travel-height lower limit value βhu (i.e., lower limit value of the height inclination angle for rearward travel of the snow removal machine 10) is preset at a predetermined value such that the lower end of the auger housing 25 will not drag or slide in the ground surface Gr during rearward travel of the snow removal machine 10.

If the current actual height inclination angle βhr is smaller than (or below) the rearward-travel-height lower limit value βhu as determined at step S411, the lifting relay 96 is turned on so that electric power is supplied to the electric motor 16*a* to rotate the electric motor 16*a* in the reverse rotational direction for upward height drive at step S412, after which the control section 61 terminates the instant subroutine to revert to step S14 of FIG. 8. Thus, the lifting/lowering drive mechanism 16 lifts the auger housing 25 and the blower case 26. Such upward drive by the lifting/lowering drive mechanism 16 continues until it is determined that the actual height inclination angle βhr has risen up to the rearward-travel height lower limit value βhu.

If the current actual height inclination angle βhr has risen up to the rearward-travel-height lower limit value βhu as determined at step S411, the control section 611 turns off the lifting relay 96 to thereby deactivate the electric motor 16*a* for stopping height drive at step S413, after which the control section 61 terminates the instant subroutine to revert to step S14 of FIG. 8.

Further, if the current operating direction of the direction-speed operation lever 53 is "forward", the control section 61 determines that forward travel control is to be performed and thus terminates the instant subroutine to proceed to step S414.

Next, at step S414, the control section 61 reads a switch signal of the auger switch 45. Then, the control section 61 determines at step S415 whether the auger switch 45 is currently ON. If the auger switch 45 is currently OFF as determined at step S415, the control section 61 terminates the instant subroutine to revert to step S14 of FIG. 8. If the auger switch 45 is currently ON as determined at step S414, the auger 31 and the blower 32 are driven to perform snow removal work, and the control flow proceeds to step S416.

At step S416, the current actual height inclination angle βhr (overall inclination angle βhr in the limiting/lowering direction) is compared with the target height inclination angle βhs. If the current actual height inclination angle βhr is below the target height inclination angle βhs as determined at step S416, the control flow goes to step S417. If, on the other hand, the current actual height inclination angle βhr is above the target height inclination angle βhs as determined at step S416, the control flow goes to step S418.

At step S417, the control section 61 turns on the lifting relay 96 to supply electric power to the electric motor 16*a* so as to rotate the electric motor 16*a* in the reverse rotational direction for upward height drive, after which the control section 61 terminates the instant subroutine to revert to step S14 of FIG. 8. Thus, the lifting/lowering drive mechanism 16 lifts the auger housing 25 and the blower case 26. Such upward drive by the lifting/lowering drive mechanism 16 continues until it is determined at step S416 that the current actual height inclination angle βhr has equaled the target height inclination angle βhs.

At step S418, the control section 61 turns on the lowering relay 95 to supply electric power to the electric motor 16*a* so as to rotate the electric motor 16*a* in the forward rotational direction for downward height drive, after which the control section 61 terminates the instant subroutine to revert to step S14 of FIG. 8. Thus, the lifting/lowering drive mechanism 16 lowers the auger housing 25 and the blower case 26. Such downward drive by the lifting/lowering drive mechanism 16 continues until it is determined at step S416 that the current actual height inclination angle βhr has equaled the target height inclination angle βhs.

Once the current actual height inclination angle βhr has equaled the target height inclination angle βhs as determined at step S416, the control section 61 turns off both of the lowering relay 95 and the lifting relay 96 to deactivate the electric motor 16*a* for stopping the height drive at step S419, after which the control section 61 terminates the instant subroutine to revert to step S14 of FIG. 8.

As clear from the foregoing, the frame inclination angle detection section 64, which comprises the acceleration sensor, indirectly detects, at steps S106 and 206, inclination angles θr and θh of the travel unit frame 12 itself relative to the ground surface Gr (horizontal flat surface), which the travel units 11L and 11R are contacting, by detecting acceleration αr and αh. The above-mentioned acceleration sensor, constituting the frame inclination angle detection section 64, is a detection section that detects basic information (acceleration αr and αh) for obtaining the inclination angles θr and θh. However, the frame inclination angle detection section 64 is not limited to the aforementioned construction based on the acceleration sensor, and it may be constructed to directly detect inclination angles θr and θh of the travel unit frame 12 itself relative to the ground surface Gr (horizontal flat surface).

Steps S101 to S110 of FIG. 9 and steps S201 to S210 together constitute an "overall inclination evaluation section 131" that evaluates overall inclination angles βrr and βhr relative to the ground surface Gr (horizontal flat surface).

Steps S104 and S105 of FIG. 9 and steps S204 and S205 of FIG. 10 together constitute a filter 132. Thus, the overall inclination evaluation section 131 has a filter function that, when it has been determined that the snow removal machine 10 is traveling at an accelerating or decelerating speed or turning, slowly changes values of inclination angles (including acceleration αr and αh) detected by the frame inclination angle detection section 64.

The memory 63 shown in FIG. 5 constitutes an inclination storage section that stores overall inclination angles βrr and βhr detected at an operation end time point when a human operator's operation of the housing posture operation section 100 has ended.

Steps S313 to S316 of FIG. 12 and steps S416 to S416 of FIG. 14 together constitute a "housing posture control section 133" that controls the lifting/lowering drive mechanism 16 and the rolling drive mechanism 65 so that the overall inclination angles βrr and βhr stored in the inclination storage section 63 as above can be maintained even after the operation end time point when the human operator's operation of the housing posture operation section 100 has ended.

Namely, the housing posture control section 133 perform control for maintaining the overall inclination angles βrr and βhr, upon determination that a first condition that the auger 31 is rotating and a second condition that the snow removal machine 10 is traveling forward is satisfied. The first condition that the auger 31 is rotating is satisfied if the auger switch 45 is ON as determined at step S312 or S414. The second condition that the snow removal machine 10 is traveling forward is satisfied if the operating direction of the direction-speed lever 53 is forward as determined at step S310 or S410.

As noted above, during snow removal work, the housing posture control section 133 maintains the overall inclination angles βrr and βhr stored in the inclination storage section 63. If the lower end of the auger housing 25 is located too low when the snow removal machine 10 travels rearward, the lower end of the auger housing 25 may undesirably drag or slide on the ground surface Gr, and/or get stuck with concavities and convexities on the ground surface Gr. To avoid such inconveniences, the housing posture control section 133 automatically lifts, at the time of rearward travel of the snow removal machine 10, the auger housing 25 up to the rearward-travel height lower limit value βhu. When snow removal work is to be performed again after that, the housing posture control section 133 performs control for maintaining the overall inclination angles βrr and βhr stored in the inclination storage section 63. Such arrangements can eliminate a need for the human operator to perform an operation for lifting or lowering the auger housing 25 each time snow removal and rearward travel is to be repeated, and thus can significantly reduce the number of operations to be performed by the human operator and thereby significantly enhance operability of the snow removal machine 10.

Further, if the human operator has become unable to identify current inclination angles, the human operator only has to turn on the reset switch 54. In response to the human operator thus turning on the reset switch 54, the auger housing 25 is automatically returned to a preset initial or original posture. Namely, because the auger housing 25 is automatically returned to an absolute horizontal posture and a predetermined height position, it is possible to eliminate a need for the human operator to return the auger housing 25 to the preset initial posture.

The basic principles of the present disclosure are well suited for application to auger-type snow removal machines where at least the auger is driven by an engine. Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is to be interpreted by the appended claims rather than by the foregoing description.

What is claimed is:

1. A snow removal machine including a travel unit frame having a travel unit mounted thereon, and an auger housing having an auger housed therein and not only liftable and lowerable but also rollable relative to the travel unit frame, the snow removal machine comprising:

a frame inclination angle detection section for detecting an inclination angle of the travel frame itself relative to a ground surface with which the travel unit is contacting;

a housing inclination angle detection section for detecting an inclination angle of the auger housing relative to the travel unit frame; and an overall inclination angle evaluation section for evaluating an overall inclination angle of the auger housing relative to the ground surface on the basis of the inclination angle detected by the frame inclination angle detection section and the inclination angle detected by the housing inclination angle detection section, wherein the frame inclination angle detection section and the housing inclination angle detection section being provided on a part of the snow removal machine which does not make rolling motion together with the auger housing, and wherein the overall inclination angle evaluation section has a filter function that, upon determination that the snow removal machine is traveling at an accelerating or decelerating speed or making a turn, slowly changes a value of the inclination angle detected by the frame inclination angle detection section.

2. The snow removal machine according to claim 1, further comprising a machine body frame having a rear end portion pivotally connected to the travel unit frame for undergoing pivotal movement in a vertical plane, the machine body frame being not rollable relative to the travel unit frame, wherein the housing inclination angle detection section includes a first housing inclination angle detection section detecting an inclination angle of the auger housing, in a longitudinal direction, relative to the travel unit frame and a second housing inclination angle detection section detecting an inclination angle of the auger housing, in a left-right direction, relative to the vehicle body frame, wherein the snow removal machine further includes a rolling drive actuator to drive the auger housing to roll by an actuation movement of the rolling drive actuator, the rolling drive actuator being provided to the machine body frame, and wherein the second housing inclination angle detection section is provided to the machine body frame separately from the rolling drive actuator so as not to move together with the actuation movement of the rolling drive actuator.

3. The snow removal machine according to claim 1, which further comprises:

a lifting and lowering drive mechanism for lifting and lowering the auger housing;

a rolling drive mechanism for rolling the auger housing;

a housing posture operation section for operating the lifting and lowering drive mechanism and the rolling drive mechanism;

an inclination storage section for storing the overall inclination angle detected at an operation end time point when an operation via the housing posture operation section has been ended; and a housing posture control section for, following the operation end time point, controlling the lifting and lowering drive mechanism and the rolling drive mechanism in such a manner that the overall inclination angle stored in the inclination storage section is maintained.

4. The snow removal machine according to claim 3, wherein the housing posture control section performs control for maintaining the overall inclination angle only upon determination that of both of a first condition that the auger is rotating and a second condition that the snow removal machine is traveling forward is satisfied.

5. The snow removal machine according to claim 2, wherein the second housing inclination angle detection section comprises a potentiometer fixedly mounted on the front end portion of the machine body frame, the potentiometer having a rotary input shaft extending parallel to an axis of rolling movement of the auger housing, and a link mechanism operatively interconnecting the input shaft of the potentiometer and a part of the auger housing such that rolling movement of the auger housing is transmitted via the link mechanism to the input shaft of the potentiometer.

6. The snow removal machine according to claim 2, further comprising a control section for controlling operation of the snow removal machine, wherein the travel unit frame includes left and right operating handles extending obliquely rearward and upward from a rear end portion thereof, the control section being provided between the left and right operating handles, and the frame inclination angle detection section being incorporated in the control section.

7. The snow removal machine according to claim 5, further comprising a control section for controlling operation of the snow removal machine, wherein the travel unit frame includes left and right operating handles extending obliquely rearward and upward from a rear end portion thereof, the control section being provided between the left and right operating handles, and the frame inclination angle detection section being incorporated in the control section.

8. The snow removal machine according to claim 2, wherein the frame inclination angle detection section includes a frame inclination angle detection sensor provided on the travel unit frame and the housing inclination angle detection section includes a housing inclination angle detection sensor provided on the machine body frame.

9. The snow removal machine according to claim 2, wherein the first housing inclination angle detection section detects the inclination angle of the auger housing and the machine body frame, in the longitudinal direction, relative to the travel unit frame.

10. A snow removal machine comprising:

a travel unit frame having a travel unit mounted thereon;

a machine body frame having a rear end portion pivotally connected to the travel unit frame for undergoing pivotal movement in a vertical plane, the machine body frame being not rollable relative to the travel unit frame;

an auger housing rollably mounted on a front end portion of the machine body frame, the auger housing having an auger housed therein and being not only liftable and lowerable but also rollable relative to the travel unit frame;

a frame inclination angle detection section for detecting an inclination angle of the travel frame itself relative to a ground surface with which the travel unit is contacting;

a housing inclination angle detection section for detecting an inclination angle of the auger housing relative to the travel unit frame; and an overall inclination angle evaluation section for evaluating an overall inclination angle of the auger housing relative to the ground surface on the basis of the inclination angle detected by the frame inclination angle detection section and the inclination angle detected by the housing inclination angle detection section, wherein the frame inclination angle detection section and the housing inclination detection section are provided on a part of the snow removal machine which does not make rolling motion together with the auger housing, wherein the frame inclination angle detection section is provided on the travel unit frame and the housing inclination angle detection section is provided on the machine body frame, and wherein the housing inclination angle detection section comprises a potentiometer fixedly mounted on the front end portion of the machine body frame, the potentiometer having a rotary input shaft extending parallel to an axis of rolling movement of the auger housing, and a link mechanism operatively interconnecting the input shaft of the potentiometer and a part of the auger housing such that rolling movement of the auger housing is transmitted via the link mechanism to the input shaft of the potentiometer.

11. The snow removal machine according to claim 10, further comprising a control section for controlling operation of the snow removal machine, wherein the travel unit frame includes left and right operating handles extending obliquely rearward and upward from a rear end portion thereof, the control section being provided between the left and right operating handles, and the frame inclination angle detection section being incorporated in the control section.

* * * * *